US009537212B2

(12) United States Patent
Rosen et al.

(10) Patent No.: US 9,537,212 B2
(45) Date of Patent: Jan. 3, 2017

(54) ANTENNA ARRAY SYSTEM FOR PRODUCING DUAL CIRCULAR POLARIZATION SIGNALS UTILIZING A MEANDERING WAVEGUIDE

(71) Applicant: The Boeing Company, Seal Beach, CA (US)

(72) Inventors: Harold A. Rosen, Santa Monica, CA (US); Paul J. Tatomir, Fallbrook, CA (US); Parthasarathy Ramanujam, Torrance, CA (US); Sasha J. Courtade, Santa Monica, CA (US); Joshua Maxwell Rutheiser, Seattle, WA (US)

(73) Assignee: THE BOEING COMPANY, Seal Beach, CA (US)

( * ) Notice: Subject to any disclaimer, the term of this patent is extended or adjusted under 35 U.S.C. 154(b) by 505 days.

(21) Appl. No.: 14/180,873

(22) Filed: Feb. 14, 2014

(65) Prior Publication Data

US 2015/0236414 A1 Aug. 20, 2015

(51) Int. Cl.

| | |
|---|---|
| ***H01Q 3/22*** | (2006.01) |
| ***H01Q 3/34*** | (2006.01) |
| ***H01Q 19/19*** | (2006.01) |
| ***H01Q 13/02*** | (2006.01) |
| ***H01Q 15/24*** | (2006.01) |
| ***H01Q 21/06*** | (2006.01) |
| ***H01Q 21/00*** | (2006.01) |

(52) U.S. Cl.

CPC ..... *H01Q 3/22* (2013.01); *H01Q 3/34* (2013.01); *H01Q 13/0233* (2013.01); *H01Q 15/24* (2013.01); *H01Q 19/19* (2013.01); *H01Q 21/005* (2013.01); *H01Q 21/0043* (2013.01); *H01Q 21/064* (2013.01)

(58) Field of Classification Search

CPC .... H01Q 3/22; H01Q 13/0233; H01Q 21/005; H01Q 21/0043; H01Q 21/064

See application file for complete search history.

(56) References Cited

U.S. PATENT DOCUMENTS

| | | | | |
|---|---|---|---|---|
| 3,473,162 A | | 10/1969 | Veith | |
| 4,348,680 A | * | 9/1982 | Collier | H01Q 3/22 342/375 |
| 4,864,308 A | * | 9/1989 | Raab | H01Q 3/22 342/157 |
| 7,286,093 B2 | | 10/2007 | Artis | |
| 7,289,077 B2 | | 10/2007 | Artis | |

OTHER PUBLICATIONS

European Patent Office Communication re European Search Report, Application No. 15152493.1.

* cited by examiner

*Primary Examiner* — Gregory C Issing
(74) *Attorney, Agent, or Firm* — Francisco A. Rubio-Campos; The Boeing Company

(57) ABSTRACT

An antenna array system for directing and steering an antenna beam is described in accordance with the present invention. The antenna array system may include a feed waveguide having a feed waveguide length, at least two directional couplers in signal communication with the feed waveguide, at least two pairs of planar coupling slots along the feed waveguide length, and at least two horn antennas.

20 Claims, 16 Drawing Sheets

ANTENNA ARRAY SYSTEM FOR PRODUCING DUAL CIRCULAR POLARIZATION SIGNALS UTILIZING A MEANDERING WAVEGUIDE

BACKGROUND OF THE INVENTION

1. Field of the Invention

This present invention relates generally to microwave devices, and more particularly, to antenna arrays.

2. Related Art

In today's modern society satellite communication systems have become common place. There are now numerous types of communication satellites in various orbits around the Earth transmitting and receiving huge amounts of information. Telecommunication satellites are utilized for microwave radio relay and mobile applications, such as, for example, communications to ships, vehicles, airplanes, personal mobile terminals, Internet data communication, television, and radio broadcasting. As a further example, with regard to Internet data communications, there is also a growing demand for in-flight Wi-Fi® Internet connectivity on transcontinental and domestic flights. Unfortunately, because of these applications, there is an ever increasing need for the utilization of more communication satellites and the increase of bandwidth capacity of each of these communication satellites.

An obvious problem to solving this need is that individual communication satellite systems are very expensive to fabricate, place in Earth orbit, and operate and maintain. Another problem to solving this need is that there are limiting design factors to increasing the bandwidth capacity in a new communication satellite. One of these limiting design factors is the relative compact physical size and weight of a communication satellite. Communication satellite designs are limited by the size and weight parameters that are capable of being loaded into and delivered into orbit by a modern satellite delivery system (i.e., the rocket system). The size and weight limitations of the communication satellite limit the type of electrical, electronic, power generation, and mechanical subsystems that may be included in the communication satellite. As a result, the limit of these types of subsystems are also limiting factors to increasing the bandwidth capacity of the satellite communication.

It is appreciated by those skilled in the art, that in general, the limiting factors to increased bandwidth capacity of the communication satellite are determined by the transponders, antenna system(s), and processing system(s) of the communication satellite.

With regard to the antenna system (or systems), most communication satellite antenna systems include some type of antenna array system. In the past reflector antennas (such as parabolic dishes) were utilized with varying numbers of feed array elements (such as feed horns). Unfortunately, typically these reflector antenna systems scanned their antenna beams utilizing mechanical means instead of electronic means. These mechanical means generally include relatively large, bulky, and heavy mechanisms (i.e., antenna gimbals).

More recently, there have been satellites that have been designed utilizing non-reflector phased array antenna systems. These phased array antenna systems are capable of increasing the bandwidth capacity of the antenna system as compared to previous reflector type of antenna systems. Additionally, these phased array antenna systems are capable of directing and steering antenna beams sometimes without mechanically moving the phase array antenna system. Generally, dynamic phased array antenna systems utilize variable phase shifters to move the antenna beam without physically moving the phased array antenna system. Fixed phased array antenna systems, on the other hand, utilize fixed phased shifters to produce an antenna beam that is stationary with respect to the face of the phased array antenna system. A such, fixed phased array antenna systems require the movement of the entire antenna system (with for example, an antenna gimbal) to directing and steering the antenna beam.

Unfortunately, while dynamic phased array antenna systems are more desirable then fixed phased array antenna systems they are also more complex and expensive since they require specialized active components (such as power amplifiers and active phase shifters) and control systems. As such, there is a need for a new type of phased array antenna system capable of electronically scanning an antenna beam that is robust, efficient, compact, and solves the previously described problems.

SUMMARY

An antenna array system for directing and steering an antenna beam is described in accordance with the present invention. In an example of an implementation, the antenna array system may include a feed waveguide having a feed waveguide length, at least two directional couplers in signal communication with the feed waveguide, at least two pairs of planar coupling slots along the feed waveguide length, and at least two horn antennas. The feed waveguide may have a feed waveguide wall, at least one turn along the feed waveguide length, a first feed waveguide input at a first end of the feed waveguide, and a second feed waveguide input at a second end of the feed waveguide. The feed waveguide is configured to receive a first input signal at the first feed waveguide input and a second input signal at the second feed waveguide input.

Each directional coupler, of the at least two directional couplers, has a bottom wall that is adjacent to the waveguide wall of the feed waveguide and each directional coupler is configured to produce a first coupled signal from the first input signal and a second coupled signal from the second input signal. A first pair of planar coupling slots, of the at least two pairs of planar coupling slots, corresponds to the a first directional coupler, of the at least two directional couplers, and a second pair of planar coupling slots, of the at least two pairs of planar coupling slots, corresponds to the a second directional coupler, of the at least two directional couplers. Additionally, the first pair of planar coupling slots are cut into the feed waveguide wall of the feed waveguide and the adjacent bottom wall of the first directional coupler and the second pair of planar coupling slots are cut into the feed waveguide wall of the feed waveguide and the adjacent bottom wall of the second directional coupler.

A first horn antenna, of the at least two horn antennas, is in signal communication with the first directional coupler and a second horn antenna, of the at least two horn antennas, is in signal communication with the second directional coupler. The first horn antenna is configured to receive both the first coupled signal and the second coupled signal from the first directional coupler and the second horn antenna is configured to receive both the first coupled signal and the second coupled signal from the second directional coupler. Additionally, the first horn antenna is configured to produce a first polarized signal from the received first coupled signal and a second polarized signal from the received second coupled signal and the second horn antenna is configured to produce a first polarized signal from the received first coupled signal and a second polarized signal from the received second coupled signal, where the first polarized signal of the first horn antenna is cross polarized with the second polarized signal of the first horn antenna and the first polarized signal of the second horn antenna is cross polarized with the second polarized signal of the second horn antenna. Furthermore, the first polarized signal of the first horn antenna is polarized in the same direction as the first polarized signal of the second horn antenna and the second polarized signal of the first horn antenna is polarized in the same direction as the second polarized signal of the second horn antenna.

In an example of operation, the antenna array system performs a method that includes receiving a first input signal at the first feed waveguide input and a second input signal at the second feed waveguide input, wherein the second input signal is propagating in the opposite direction of the first input signal. Coupling the first input signal to a first directional coupler, of the at least two directional couplers, where the first directional coupler produces a first coupled output signal of the first directional coupler and coupling the first input signal to a second directional coupler, of the at least two directional couplers, where the second directional coupler produces a first coupled output signal of the second directional coupler. The method also includes coupling the second input signal to the second directional coupler, wherein the second directional coupler produces a second coupled output signal of the second directional coupler and coupling the second input signal to the first directional coupler, where the first directional coupler produces a second coupled output signal of the first directional coupler. The method further includes radiating a first polarized signal from a first horn antenna, of the at least two horn antennas, in response to the first horn antenna receiving the first coupled output signal of the first directional coupler and radiating a second polarized signal from the first horn antenna, in response to the first horn antenna receiving the second coupled output signal of the first directional coupler. The method moreover includes radiating a first polarized signal from a second horn antenna, of the at least two horn antennas, in response to the second horn antenna receiving the second coupled output signal of the second directional coupler and radiating a second polarized signal from the second horn antenna, in response to the second horn antenna receiving the second coupled output signal of the second directional coupler.

In another example of an implementation, the antenna array system may include a feed waveguide having a feed waveguide length, at least four directional couplers in signal communication with the feed waveguide, at least four pairs of planar coupling slots along the feed waveguide length, and at least two horn antennas. The feed waveguide may have a feed waveguide wall, at least five turns along the feed waveguide length, a first feed waveguide input at a first end of the feed waveguide, and a second feed waveguide input at a second end of the feed waveguide. The feed waveguide is configured to receive a first input signal at the first feed waveguide input and a second input signal at the second feed waveguide input.

Each directional coupler, of the at least four directional couplers, has a bottom wall that is adjacent to the waveguide wall of the feed waveguide and each directional coupler is configured to produce a coupled signal from either the first input signal or the second input signal. A first pair of planar coupling slots, of the at least four pairs of planar coupling slots, corresponds to the a first directional coupler, of the at least four directional couplers; a second pair of planar coupling slots, of the at least four pairs of planar coupling slots, corresponds to the a second directional coupler, of the at least four directional couplers; a third pair of planar coupling slots, of the at least four pairs of planar coupling slots, corresponds to the a third directional coupler, of the at least four directional couplers; and a fourth pair of planar coupling slots, of the at least four pairs of planar coupling slots, corresponds to the a fourth directional coupler, of the at least four directional couplers. The first pair of planar coupling slots are cut into the feed waveguide wall of the feed waveguide and the adjacent bottom wall of the first directional coupler; the second pair of planar coupling slots are cut into the feed waveguide wall of the feed waveguide and the adjacent bottom wall of the second directional coupler; the third pair of planar coupling slots are cut into the feed waveguide wall of the feed waveguide and the adjacent bottom wall of the third directional coupler; and the fourth pair of planar coupling slots are cut into the feed waveguide wall of the feed waveguide and the adjacent bottom wall of the fourth directional coupler.

A first horn antenna, of the at least two horn antennas, is in signal communication with the first directional coupler and the second directional coupler and a second horn antenna, of the at least two horn antennas, is in signal communication with the third directional coupler and the fourth directional coupler. The first horn antenna is configured to receive the coupled signal from the first directional coupler and the coupled signal from the second directional coupler and the second horn antenna is configured to receive the coupled signal from the third directional coupler and the coupled signal from the fourth directional coupler. Additionally, the first horn antenna is configured to produce a first polarized signal from the received coupled signal from the first directional coupler and a second polarized signal from the received coupled signal from the second directional coupler and the second horn antenna is configured to produce a first polarized signal from the received coupled signal from the third directional coupler and a second polarized signal from the received coupled signal from the fourth directional coupler, where the first polarized signal of the first horn antenna is cross polarized with the second polarized signal of the first horn antenna and the first polarized signal of the second horn antenna is cross polarized with the second polarized signal of the second horn antenna. Moreover, the first polarized signal of the first horn antenna is polarized in the same direction as the first polarized signal of the second horn antenna and second polarized signal of the first horn antenna is polarized in the same direction as the second polarized signal of the second horn antenna.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1A:
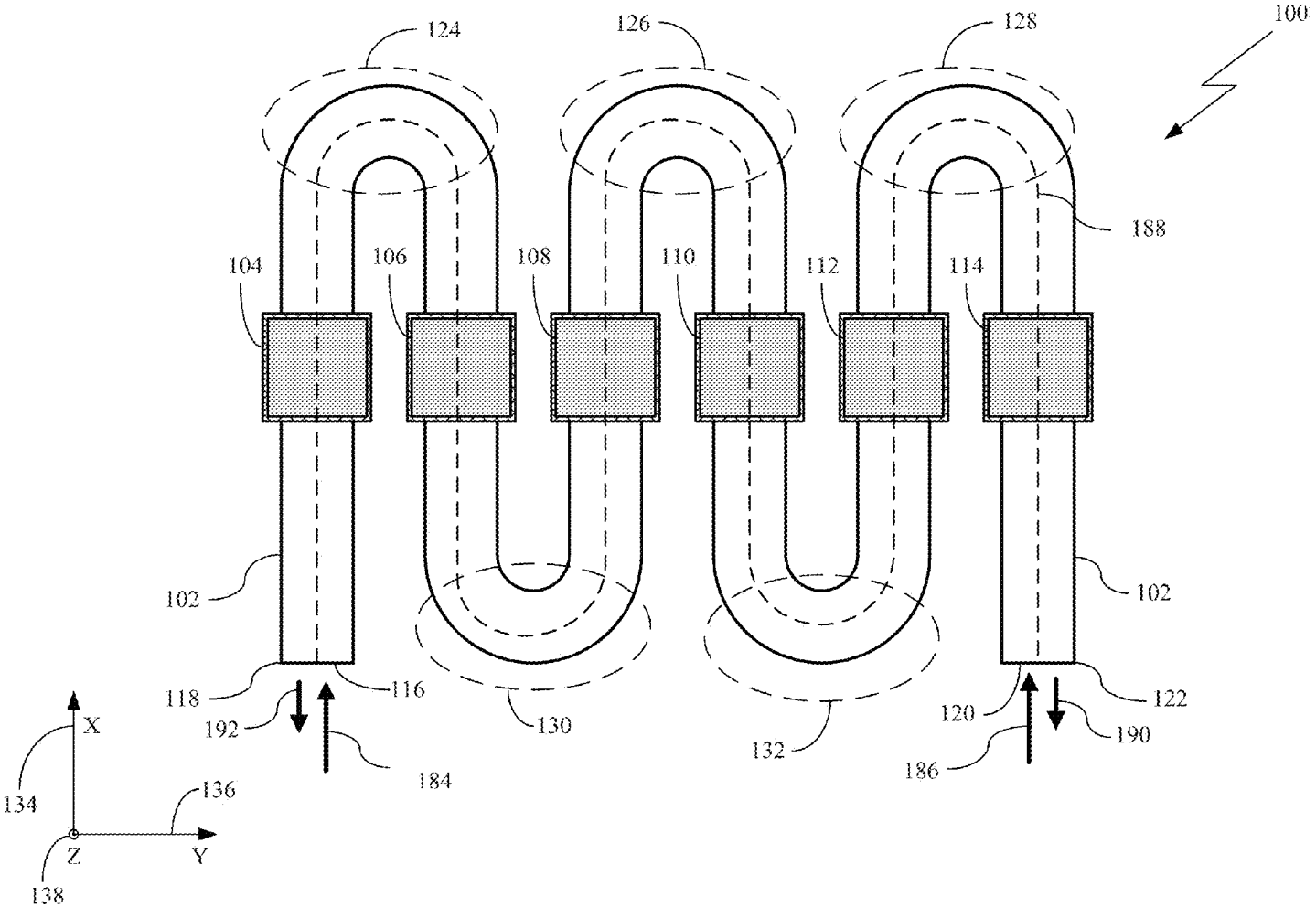
FIG. 1A is a top view of the example of the implementation of an antenna array system in accordance with the present invention.

An antenna array system for directing and steering an antenna beam is described in accordance with the present invention. In an example of an implementation, the antenna array system may include a feed waveguide having a feed waveguide length, at least two directional couplers in signal communication with the feed waveguide, at least two pairs of planar coupling slots along the feed waveguide length, and at least two horn antennas. The feed waveguide may have a feed waveguide wall, at least one turn along the feed waveguide length, a first feed waveguide input at a first end of the feed waveguide, and a second feed waveguide input at a second end of the feed waveguide. The feed waveguide is configured to receive a first input signal at the first feed waveguide input and a second input signal at the second feed waveguide input.

Each directional coupler, of the at least two directional couplers, has a bottom wall that is adjacent to the waveguide wall of the feed waveguide and each directional coupler is configured to produce a first coupled signal from the first input signal and a second coupled signal from the second input signal. A first pair of planar coupling slots, of the at least two pairs of planar coupling slots, corresponds to the a first directional coupler, of the at least two directional couplers, and a second pair of planar coupling slots, of the at least two pairs of planar coupling slots, corresponds to the a second directional coupler, of the at least two directional couplers. Additionally, the first pair of planar coupling slots are cut into the feed waveguide wall of the feed waveguide and the adjacent bottom wall of the first directional coupler and the second pair of planar coupling slots are cut into the feed waveguide wall of the feed waveguide and the adjacent bottom wall of the second directional coupler.

A first horn antenna, of the at least two horn antennas, is in signal communication with the first directional coupler and a second horn antenna, of the at least two horn antennas, is in signal communication with the second directional coupler. The first horn antenna is configured to receive both the first coupled signal and the second coupled signal from the first directional coupler and the second horn antenna is configured to receive both the first coupled signal and the second coupled signal from the second directional coupler. Additionally, the first horn antenna is configured to produce a first polarized signal from the received first coupled signal and a second circularly signal from the received second coupled signal and the second horn antenna is configured to produce a first polarized signal from the received first coupled signal and a second polarized signal from the received second coupled signal, where the first polarized signal of the first horn antenna is cross polarized with the second polarized signal of the first horn antenna and the first polarized signal of the second horn antenna is cross polarized with the second polarized signal of the second horn antenna. Furthermore, the first polarized signal of the first horn antenna is polarized in the same direction as the first polarized signal of the second horn antenna and second polarized signal of the first horn antenna is polarized in the same direction as the second polarized signal of the second horn antenna.

The polarizations of the first polarized signals and second polarized signals of the first horn antenna and second horn antenna, respectively, may be any desired polarization scheme including linear polarization, circular polarization, elliptical polarization, etc. As an example, the first polarized signal and the second polarized signal of the first horn antenna may be a first linearly polarized signal and second linearly polarized signal where the first linearly polarized signal and second linearly polarized signal are cross polarized (i.e., the polarizations are orthogonal) because one may be "vertical" polarized and the other may be "horizontal" polarized. Similarly, the first polarized signal and second polarized signal of the first horn antenna may be a first linearly polarized signal and the second linearly polarized signal where the first linearly polarized signal and second linearly polarized signal are cross polarized. Additionally, in this example, the first linearly polarized signal of the first horn antenna and the first linearly polarized signal of the second horn antenna may be polarized in the same direction (i.e., both may be vertical polarized or both may be horizontally polarized). Similarly, the second linearly polarized signal of the first horn antenna and the second linearly polarized signal of the second horn antenna may be polarized in the same direction.

In the case of circular polarization, the first polarized signal and the second polarized signal of the first horn antenna may be a first circularly polarized signal and the second circularly polarized signal of the first horn where the first circularly polarized signal and second circularly polarized signal are cross polarized because the first circularly polarized signal of the first horn antenna rotates in the opposite direction of the second circularly polarized signal of the first horn antenna (i.e., one may be right-hand circularly polarized and the other may be left-hand circularly polarized). Similarly, the first polarized signal and the second polarized signal of the second horn antenna may be a first circularly polarized signal and the second circularly polarized signal of the second horn antenna where the first circularly polarized signal and second circularly polarized signal are cross polarized because the first circularly polarized signal of the second horn antenna rotates in the opposite direction of the second circularly polarized signal of the second horn antenna.

Additionally, in this example, the first circularly polarized signal of the first horn antenna and the first circularly polarized signal of the second horn antenna may be polarized in the same direction (i.e., both may rotate in the same direction such that both may be right-hand circularly polarized ("RHCP") or both may be left-hand circularly polarized ("LHCP")). Similarly, the second circularly polarized signal of the first horn antenna and the second circularly polarized signal of the second horn antenna may be polarized in the same direction.

In an example of operation, the antenna array system performs a method that includes receiving a first input signal at the first feed waveguide input and a second input signal at the second feed waveguide input, wherein the second input signal is propagating in the opposite direction of the first input signal. Coupling the first input signal to a first directional coupler, of the at least two directional couplers, where the first directional coupler produces a first coupled output signal of the first directional coupler and coupling the first input signal to a second directional coupler, of the at least two directional couplers, where the second directional coupler produces a first coupled output signal of the second directional coupler. The method also includes coupling the second input signal to the second directional coupler, wherein the second directional coupler produces a second coupled output signal of the second directional coupler and coupling the second input signal to the first directional coupler, where the first directional coupler produces a second coupled output signal of the first directional coupler. The method further includes radiating a first circularly polarized signal from a first horn antenna, of the at least two horn antennas, in response to the first horn antenna receiving the first coupled output signal of the first directional coupler and radiating a second circularly polarized signal from the first horn antenna, in response to the first horn antenna receiving the second coupled output signal of the first directional coupler. The method moreover includes radiating a first circularly polarized signal from a second horn antenna, of the at least two horn antennas, in response to the second horn antenna receiving the second coupled output signal of the second directional coupler and radiating a second circularly polarized signal from the second horn antenna, in response to the second horn antenna receiving the second coupled output signal of the second directional coupler.

In another example of an implementation, the antenna array system may include a feed waveguide having a feed waveguide length, at least four directional couplers in signal communication with the feed waveguide, at least four pairs of planar coupling slots along the feed waveguide length, and at least two horn antennas. The feed waveguide may have a feed waveguide wall, at least five turns along the feed waveguide length, a first feed waveguide input at a first end of the feed waveguide, and a second feed waveguide input at a second end of the feed waveguide. The feed waveguide is configured to receive a first input signal at the first feed waveguide input and a second input signal at the second feed waveguide input.

Each directional coupler, of the at least four directional couplers, has a bottom wall that is adjacent to the waveguide wall of the feed waveguide and each directional coupler is configured to produce a coupled signal from either the first input signal or the second input signal. A first pair of planar coupling slots, of the at least four pairs of planar coupling slots, corresponds to the a first directional coupler, of the at least four directional couplers; a second pair of planar coupling slots, of the at least four pairs of planar coupling slots, corresponds to the a second directional coupler, of the at least four directional couplers; a third pair of planar coupling slots, of the at least four pairs of planar coupling slots, corresponds to the a third directional coupler, of the at least four directional couplers; and a fourth pair of planar coupling slots, of the at least four pairs of planar coupling slots, corresponds to the a fourth directional coupler, of the at least four directional couplers. The first pair of planar coupling slots are cut into the feed waveguide wall of the feed waveguide and the adjacent bottom wall of the first directional coupler; the second pair of planar coupling slots are cut into the feed waveguide wall of the feed waveguide and the adjacent bottom wall of the second directional coupler; the third pair of planar coupling slots are cut into the feed waveguide wall of the feed waveguide and the adjacent bottom wall of the third directional coupler; and the fourth pair of planar coupling slots are cut into the feed waveguide wall of the feed waveguide and the adjacent bottom wall of the fourth directional coupler.

A first horn antenna, of the at least two horn antennas, is in signal communication with the first directional coupler and the second directional coupler and a second horn antenna, of the at least two horn antennas, is in signal communication with the third directional coupler and the fourth directional coupler. The first horn antenna is configured to receive the coupled signal from the first directional coupler and the coupled signal from the second directional coupler and the second horn antenna is configured to receive the coupled signal from the third directional coupler and the coupled signal from the fourth directional coupler. Additionally, the first horn antenna is configured to produce a first polarized signal from the received coupled signal from the first directional coupler and a second polarized signal from the received coupled signal from the second directional coupler and the second horn antenna is configured to produce a first polarized signal from the received coupled signal from the third directional coupler and a second polarized signal from the received coupled signal from the fourth directional coupler. The first polarized signal of the first horn antenna is cross polarized with the opposite direction of the second polarized signal of the first horn antenna and the first polarized signal of the second horn antenna is cross polarized with the opposite direction of the second polarized signal of the second horn antenna. Moreover, the first polarized signal of the first horn antenna is polarized in the same direction as the first polarized signal of the second horn antenna and the second polarized signal of the first horn antenna is polarized in the same direction as the second polarized signal of the second horn antenna.

Turning to FIGS. 1A, 1B, 1C, and 1D, various views of an example of an implementation of an antenna array system 100 are shown in accordance with the present invention. In FIG. 1A, a top view of the example of the implementation of an antenna array system 100 is shown. The antenna array 100 may include a feed waveguide 102, plurality of directional couplers (not shown), a plurality of horn antennas 104, 106, 108, 110, 112, and 114, and a plurality of power amplifiers (not shown). The feed waveguide 102 includes a first feed waveguide input 116 at a first end 118 of the feed waveguide 102 and a second feed waveguide input 120 at a second end 122 of the feed waveguide 102, where the second end 122 is at the opposite end of the feed waveguide 102 with respect to the first end 118. The feed waveguide 102 may be a serpentine or meandering waveguide that includes a plurality of turns (i.e., bends) 124, 126, 128, 130, and 132. In this example, the physical layout of the feed waveguide 102 may be described by three-dimensional Cartesian coordinates with coordinate axes X 134, Y 136, and Z 138, where the feed waveguide 102 is located in a plane defined by the X 134 and Y 136 coordinate axes. Additionally, the plurality of horn antennas 104, 106, 108, 110, 112, and 114 are shown extending perpendicular from the plane, defined by the X 134 and Y 136 coordinate axes, along the Z 138 coordinate axis. It is appreciated by those skilled in the art, that while only six horn antennas 104, 106, 108, 110, 112, and 114 and five turns 124, 126, 128, 130, and 132 in the feed waveguide 102 are shown, this is for illustration purposes only and antenna array system 100 may include any even number of directional couplers (not shown), horn antennas, and power amplifiers (not shown) with a corresponding number of turns needed to feed the directional couplers. As another example, the antenna array system 100 may include 60 directional couplers and horn antennas, and 59 turns in the feed waveguide. It is appreciated that the number of horn antennas determines the numbers directional couplers, and turns in the feed waveguide. Each horn antenna of the plurality of horn antennas 104, 106, 108, 110, 112, and 114 act as an individual radiating element of the antenna array system 100. In operation, each horn antenna's individual radiation pattern typically varies in amplitude and phase from each other horn antenna's radiation pattern. The amplitude of the radiation pattern for each horn antenna is controlled by a power amplifier (not shown) that controls the amplitude of the excitation current of the horn antenna. Similarly, the phase of the radiation pattern of each horn antenna is determined by the corresponding delayed phase caused by the feed waveguide 102 in feeding the directional coupler that corresponds to the horn antenna.

Figure 1B:
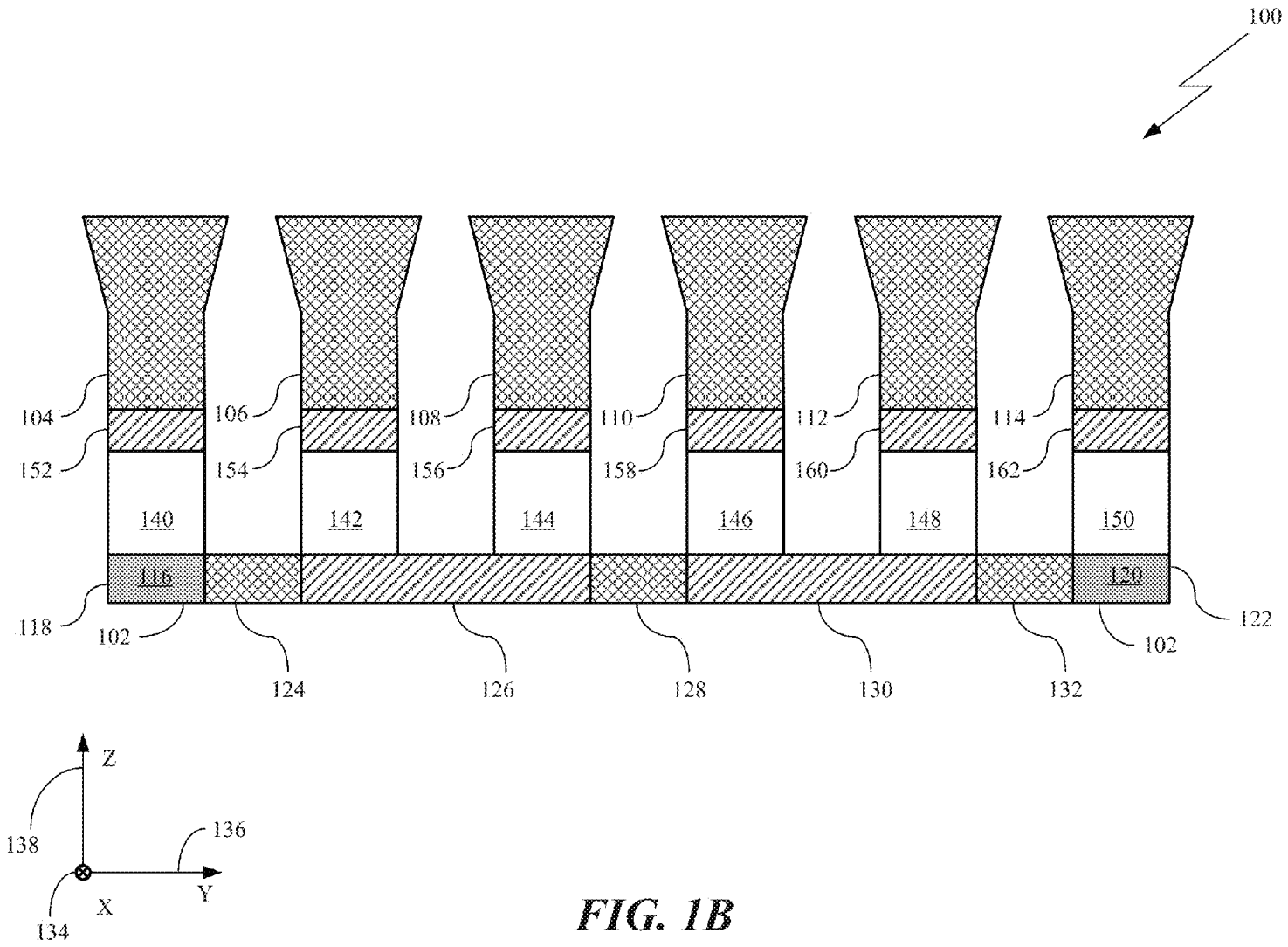
FIG. 1B is a front view of the example of the implementation of an antenna array system shown in FIG. 1A.

In FIG. 1B, a front view of the example of the implementation of an antenna array system 100 is shown. In this front view, a plurality of directional couplers 140, 142, 144, 146, 148, and 150 are shown in signal communication with the both the feed waveguide 102 and a plurality of power amplifiers 152, 154, 156, 158, 160, and 162. The plurality of power amplifiers 152, 154, 156, 158, 160, and 162 are shown in signal communication with the plurality of horn antennas 104, 106, 108, 110, 112, and 114, respectively. In this example, the feed waveguide 102 and directional couplers 140, 142, 144, 146, 148, and 150 are shown to be rectangular waveguides. For reference, the physical layout of the antenna array system 100 in this front view is shown within a plane defined by the Y 136 and Z 138 coordinate axes with the X 134 coordinate axis directed in a direction that is both perpendicular and into the Y 136 and Z 138 defined plane.

Figure 1C:
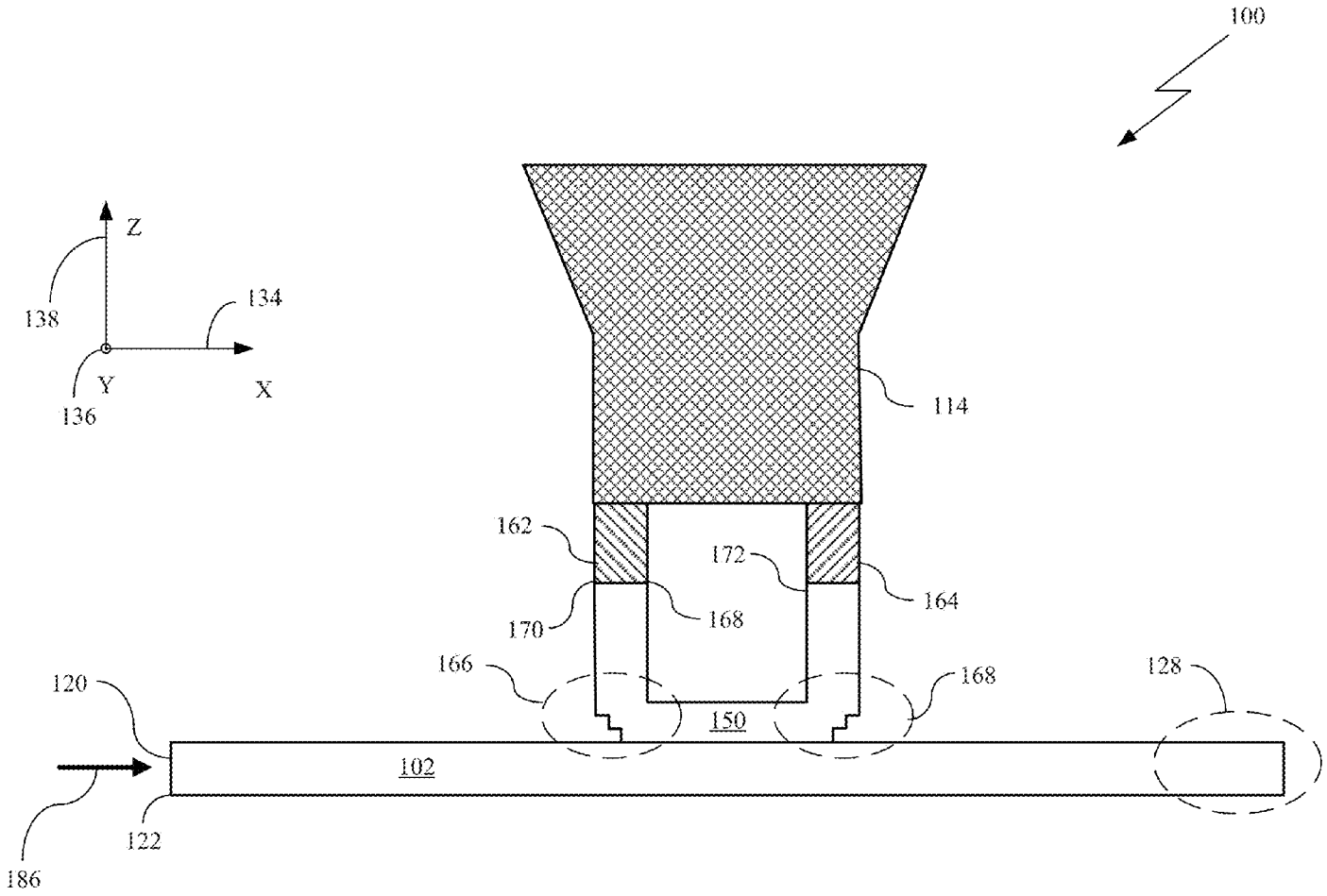
FIG. 1C is a side view of the example of the implementation of an antenna array system shown if FIGS. 1A and 1B.

In FIG. 1C, a side view of the example of the implementation of an antenna array system 100 is shown. For reference, the physical layout of the antenna array system 100 in this side view is shown within a plane defined by the X 134 and Z 138 coordinate axes with the Y 136 coordinate axis directed in a direction that is both perpendicular and out of the X 134 and Z 138 defined plane. In this side view, another power amplifier 164 is shown in signal communication with the horn antenna 114 and the directional coupler 150. In this example, the directional coupler 150 is shown to be a "U" shaped waveguide structure that is located adjacent the feed waveguide 102 having two bends 166 and 168. The first bend 166 is located close to the first power amplifier 162 and the second bend 168 is located in the opposite direction along the directional coupler 150 close to the second power amplifier 164. Specifically, the directional coupler 150 is in signal communication with the both power amplifiers 162 and 164 at a directional coupler first end 170 and second end 172, respectively.

The bent waveguide structure of the directional coupler 150 is known as an "E-bend" because it distorts the electric field, unlike the bends (i.e., turns) 124, 126, 128, 130, and 132 in the feed waveguide 102 that are known as "H-bends" because they distort the magnetic field. Generally, an E-bend waveguide may be constructed utilizing a gradual bend or by utilizing a number of step transitions (as shown in FIG. 1C) that are designed to minimize reflections in the waveguide. Similarly, an H-bend waveguide may also be constructed utilizing a gradual bend (as shown in FIG. 1A) or by utilizing a number of step transitions (shown in FIGS. 9A, 9B, and 10) that are designed to minimize reflections in the waveguide. The design of these types of H-bend and E-bend waveguides are well known in the art.

The reason for utilizing a bent waveguide structure for the directional coupler 150 is to allow the horn antenna 114 to radiate in a normal (i.e., perpendicular) direction away from the X-Y (134 and 136) plane that defines physical layout structure of the feed waveguide 102. It is appreciated that the directional coupler 150 may also be non-bent if the horn antenna 150 is designed to radiate in a direction parallel to the X-Y (134 and 136) plane that defines physical layout structure of the feed waveguide 102.

It is appreciated that while only one combination of directional coupler 150, horn antenna 114, power amplifiers 162 and 164, and feed waveguide 102 turn 128 is shown, this combination is also representative of the other directional couplers 140, 142, 144, 146, 148, and 150, plurality of power amplifiers 152, 154, 156, 158, 160, 162, and 164, horn antennas 104, 106, 108, 110, 112, and 114, and feed waveguide 102 turns 124 and 126. It is noted that feed waveguide 102 turns 130 and 132 are not visible in this side view because they are blocked by the second end 122 of the feed waveguide 102.

Figure 1D:
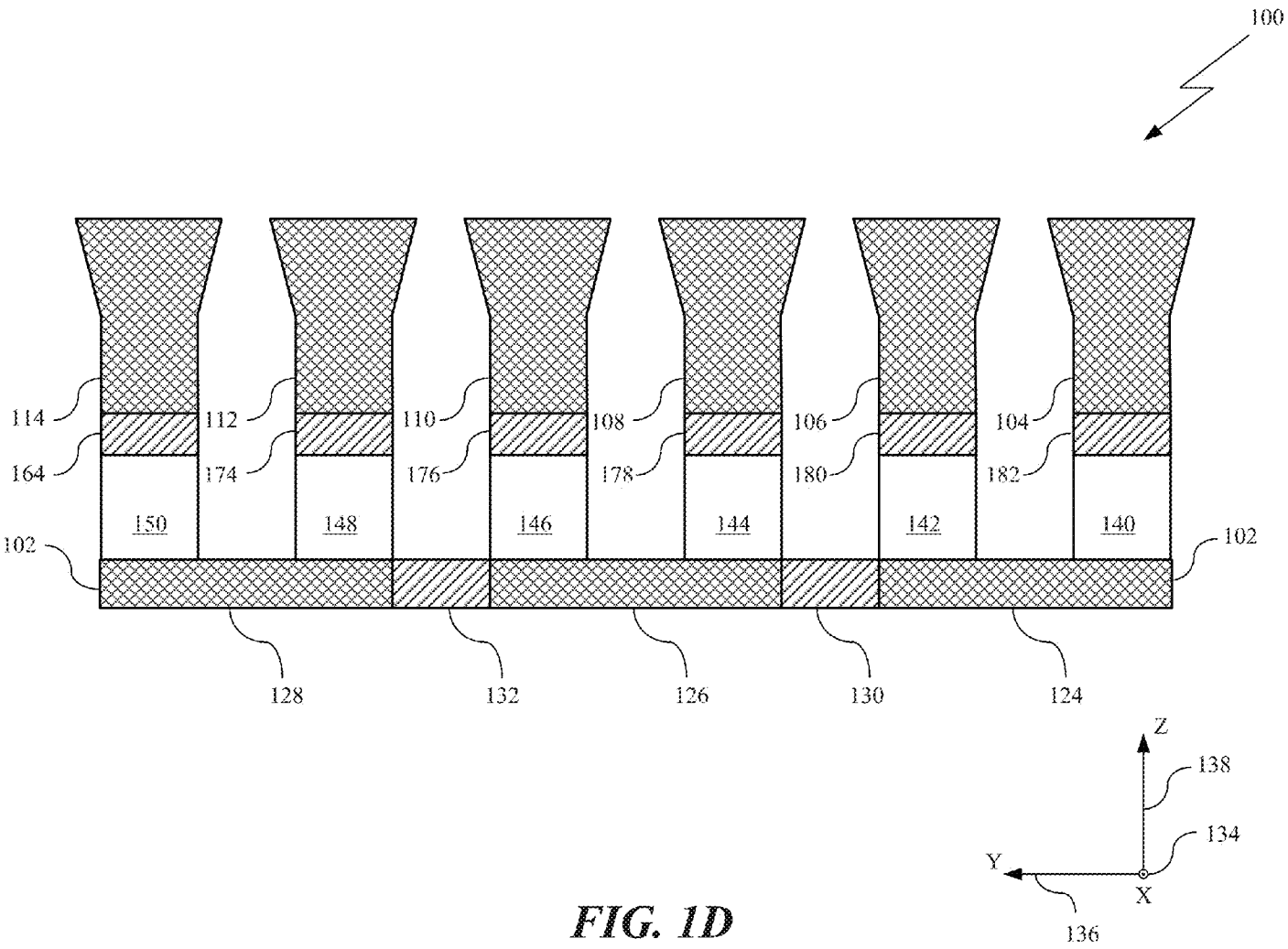
FIG. 1D is a back view of the example of the implementation of an antenna array system shown in FIGS. 1A, 1B, and 1C.

Turning to FIG. 1D, a back view of the example of the implementation of an antenna array system 100 is shown. In this back view, the plurality of directional couplers 140, 142, 144, 146, 148, and 150 are shown in signal communication with the both the feed waveguide 102 and an additional plurality of power amplifiers 164, 174, 176, 178, 180, and 182. The plurality of power amplifiers 164, 174, 176, 178, 180, and 182 are shown in signal communication with the plurality of horn antennas 114, 112, 110, 108, 106, and 104, respectively. For reference, the physical layout of the antenna array system 100 in this back view is shown within a plane defined by the Y 136 and Z 138 coordinate axes with the X 134 coordinate axis directed in a direction that is both perpendicular and extending out of the Y 136 and Z 138 defined plane.

In this example, both the feed waveguide 102 and the directional couplers 140, 142, 144, 146, 148, and 150 are shown to be rectangular waveguides having broad-walls (as seen in FIG. 1A for the feed waveguide 102 and in FIGS. 1B and 1D for the directional couplers 140, 142, 144, 146, 148, and 150) and narrow-walls (as seen in FIGS. 1B and 1D for the feed waveguide 102 and in FIG. 1C for the directional couplers 140, 142, 144, 146, 148, and 150). In operation, each directional coupler 140, 142, 144, 146, 148, and 150 utilizes a pair of planar coupling slots (not shown) located and cut into the broad-wall of the directional coupler 140, 142, 144, 146, 148, and 150 and the corresponding portion of the broad-wall of the feed waveguide 102 that is adjacent to the broad-wall of the respective directional coupler 140, 142, 144, 146, 148, and 150.

In an example of operation, the feed waveguide 102 acts as traveling wave meandering-line array feeding the plurality of directional couplers 140, 142, 144, 146, 148, and 150. The antenna array system 100 receives a first input signal 184 and a second input signal 186. Both the first input signal 184 and second input signal 186 may be $TE_{10}$, or $TE_{01}$, mode propagated signals. The first input signal 184 is input into the first feed waveguide input 116 at the first end 118 of the feed waveguide 102 and the second input signal 186 is input into the second feed waveguide input 120 at the second end 122 of the feed waveguide 102. In this example, both the first input signal 184 and second input signal 186 propagate along the direction of the X 134 coordinate axis into opposite ends of the feed waveguide 102.

Once in the feed waveguide 102, the first input signal 184 and second input signal 186 propagate along the feed waveguide 102 in opposite directions coupling parts of their respective energies into the different directional couplers. Since the first input signal 184 and second input signal 186 are traveling wave signals that are travelling in opposite directions along a length 188 of the feed waveguide 102, they will have a phase delay of about 180 degrees relative to each other at any given point within the feed waveguide 102. In general, the waveguide length 188 of the feed waveguide 102 is several wavelengths long (of the operating wavelength of the first input signal 184 and second input signal 186) so as to be long enough to create a length (not shown) between the pairs of planar coupling slots (not shown) that is also multiple wavelengths of the operating wavelengths of the first input signal 184 and second input signal 186. The reason for this length between pairs of planar coupling slots (not shown) is to create a phase increment needed for beam steering the antenna beam (not shown) of the antenna array system 100 as a function of frequency. As an example, the length between the pairs of planar coupling slots may be between 5 to 7 wavelengths long.

In this example, as the first input signal 184 travels from the first end 118 to the second end 122 of the feed waveguide 102, the first input signal 184 successively couples a portion of its energy to each direction coupler 140, 142, 144, 146, 148, and 150 until the a first remaining signal 190 of the remaining energy (if any) is outputted from the second end 122 of the feed waveguide 102. Similarly, as the second input signal 186 travels in the opposite direction from the second end 122 to the first end 118 of the feed waveguide 102, the second input signal 186 successively couples a portion of its energy to each direction coupler 140, 142, 144, 146, 148, and 150 until a second remaining signal 192 of the remaining energy (if any) of the second input signal 186 is outputted from the first end 118 of the feed waveguide 102. It is appreciated that by optimizing the design of the directional couplers 140, 142, 144, 146, 148, and 150, the first remaining signal 190 and second remaining signal 192 both may be reduced to close to zero.

In this example, when the first input signal 184 travels along the feed waveguide 102, it will couple a first portion of it energy to the directional coupler 140, which will pass this first coupled output signal to the horn antenna 104. The remaining portion of the first input signal 184 will then travel along the feed waveguide 102 to the directional coupler 142 where it will couple another portion of it energy to the directional coupler 142, which will pass this second coupled output signal to the second horn antenna 106. This process will continue such that another portion of the first input signal 184 will be coupled to directional couplers 144, 146, 148, and 150 and passed to horn antennas 108, 110, 112, and 114, respectively. The remaining portion of the first input signal 184 will then be output from the second end 122 of the feed waveguide 102 as the first remaining signal 190. Similarly, when the second input signal 186 travels along the feed waveguide 102, it will couple a first portion of it energy to the directional coupler 150, which will pass this first coupled output signal to the horn antenna 114. The remaining portion of second input signal 186 will then travel along the feed waveguide 102 to the directional coupler 148 where it will couple another portion of it energy to the directional coupler 148, which will pass this second coupled output signal to the second horn antenna 112. This process will continue such that another portion of the second input signal 186 will be coupled to directional couplers 146, 144, 142, and 140 and passed to horn antennas 110, 108, 106, and 104, respectively. The remaining portion of the second input signal 186 will then be output from the first end 118 of the feed waveguide 102 as the second remaining signal 192.

As a result, the first input signal 184 and second input signal 196 will cause the excitation of horn antennas 104, 106, 108, 110, 112, and 114. The horn antennas 104, 106, 108, 110, 112, and 114 may be configured to produce RHCP and LHCP signals when excited by the coupled portions of the first input signal 184 and second input signal 186, respectively. Alternatively, the horn antennas 104, 106, 108, 110, 112, and 114 may be configured to produce horizontal polarization and vertical polarization signals when excited by the coupled portions of the first input signal 184 and second input signal 186, respectively.

It is appreciated that a first circulator, or other isolation device, (not shown) may be connected to the first end 118 to isolate the first input signal 184 from the outputted second remaining signal 192 and a second circulator, or other isolation device, (not shown) may be connected to the second end 122 to isolate the second input signal 186 from the outputted first remaining signal 190. It is appreciated by those skilled in the art that the amount of coupled energy from the feed waveguide 102 to the respective directional couplers 140, 142, 144, 146, 148, and 150 is determined by predetermined design choices that will yield the desired radiation antenna pattern of the antenna array system 100.

It is appreciated by those skilled in the art that the circuits, components, modules, and/or devices of, or associated with, the antenna array system 100 are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

Figure 2:
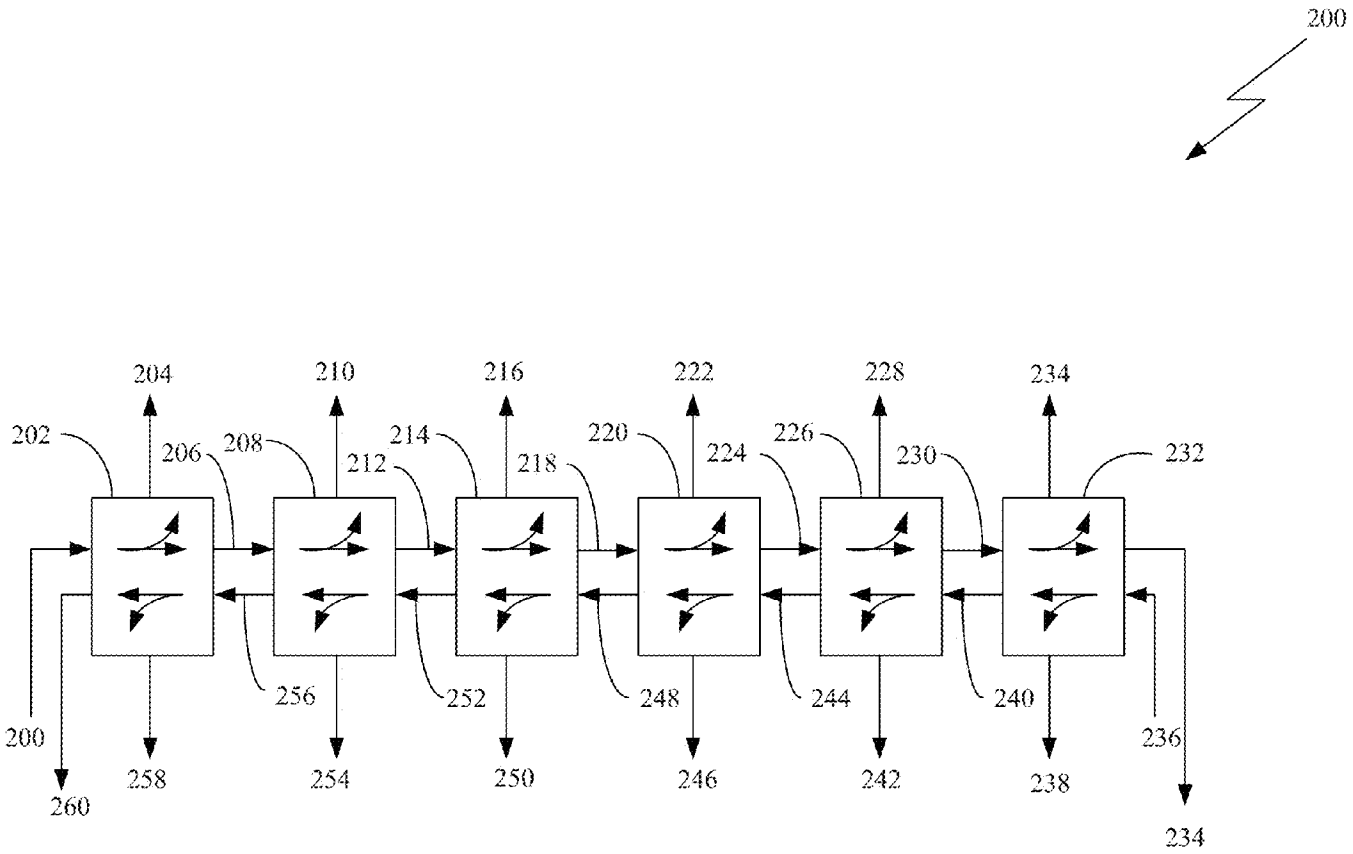
FIG. 2 is a block diagram of an example of operation of the directional couplers and the feed waveguide shown in FIGS. 1A, 1B, 1C, and 1D.

FIG. 2 is a block diagram of the example of operation of the directional couplers and the feed waveguide shown in FIGS. 1A, 1B, 1C, and 1D. As described earlier, a first input signal 200 is in injected into the feed waveguide (not shown). The feed waveguide then passes the first input signal 200 to the directional coupler 202, which produces a "forward" coupled signal 204 and passes it to the first horn antenna (not shown). The remaining first input signal 206 is then passed to directional coupler 208, which produces another forward coupled signal 210 and passes it to the another horn antenna (not shown). The remaining first input signal 212 is then passed to directional coupler 214, which produces another forward coupled signal 216 and passes it to the another horn antenna (not shown). The remaining first input signal 218 is then passed to directional coupler 220, which produces another forward coupled signal 222 and passes it to the another horn antenna (not shown). The remaining first input signal 224 is then passed to directional coupler 226, which produces another forward coupled signal 228 and passes it to the another horn antenna (not shown). Finally, the remaining first input signal 230 is then passed to directional coupler 232, which produces another forward coupled signal 234 and passes it to the another horn antenna (not shown). The first remaining signal 234 is then outputted from the feed waveguide. Similarly, a second input signal 236 is in injected into the feed waveguide (not shown). The feed waveguide then passes the second input signal 236 to the directional coupler 232, which produces a "reverse" coupled signal 238 and passes it to the same horn antenna (not shown) that the forward coupled signal 234 is passed to. The remaining second input signal 240 is then passed to directional coupler 226, which produces another reverse coupled signal 242 and passes it to the same horn antenna (not shown) that the forward coupled signal 228 is passed to. The remaining second input signal 244 is then passed to directional coupler 220, which produces another reverse coupled signal 246 and passes it to the same horn antenna (not shown) that the forward coupled signal 222 is passed to. The remaining second input signal 248 is then passed to directional coupler 214, which produces another reverse coupled signal 250 and passes it to the same horn antenna (not shown) that the forward coupled signal 216 is passed to. The remaining second input signal 252 is then passed to directional coupler 208, which produces another reverse coupled signal 254 and passes it to the same horn antenna (not shown) that the forward coupled signal 210 is passed to. Finally, the remaining second input signal 256 is then passed to directional coupler 202, which produces another reverse coupled signal 258 and passes it to the same horn antenna (not shown) that the forward coupled signal 204 is passed to. The second remaining signal 260 is then outputted from the feed waveguide.

Figure 3:
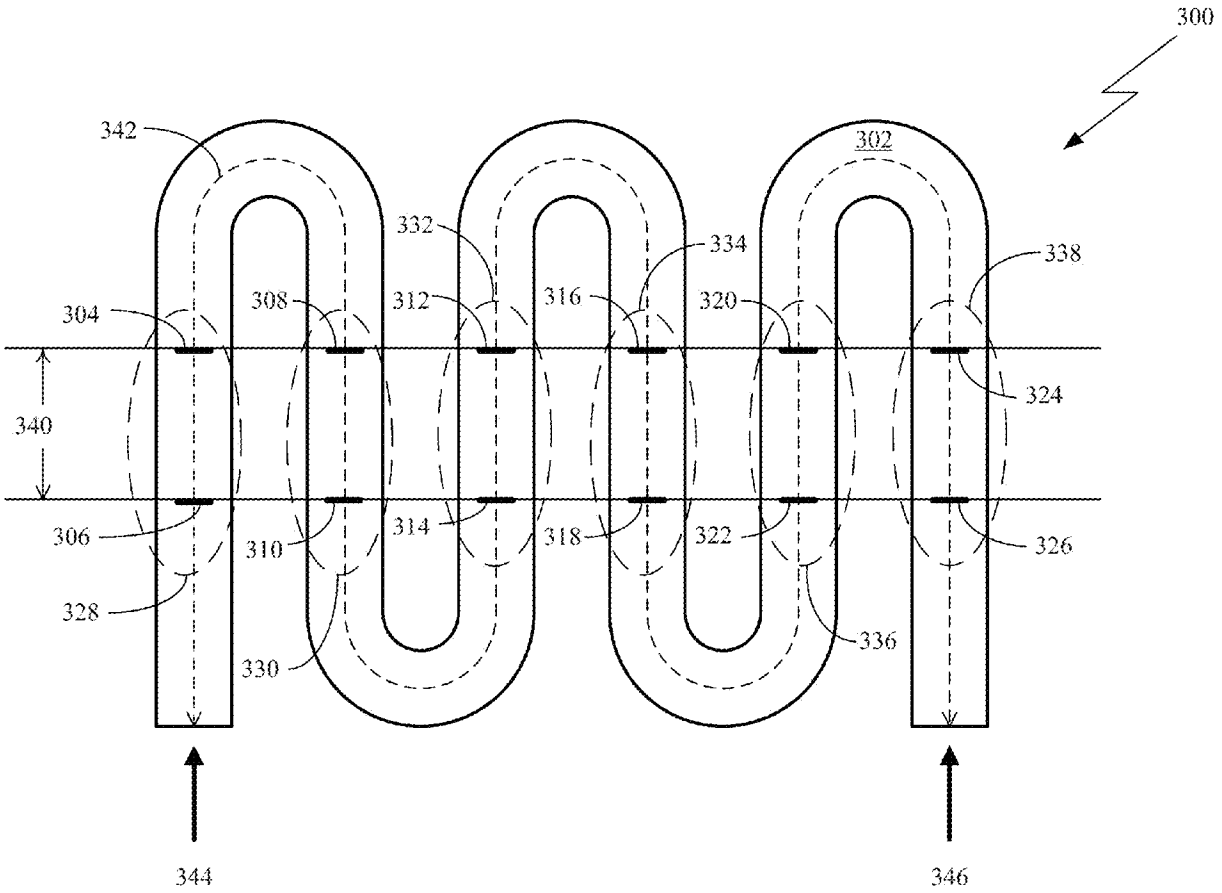
FIG. 3 is a top view of an example of an implementation of the feed waveguide (shown in FIGS. 1A, 1B, 1C, and 1D) in accordance with the present invention.

Turning to FIG. 3, a top view of an example of an implementation of the feed waveguide 300 is shown in accordance with the present invention. The feed waveguide 300 includes a broad-wall 302 and a plurality of planar coupling slots 304, 306, 308, 310, 312, 314, 316, 318, 320, 322, 324, and 326 that are organized into pairs of planar coupling slots 328, 330, 332, 334, 336, and 338, respectively. In this example, the planar coupling slots are cut into the broad-wall 302 of the feed waveguide 300 and each pair of planar coupling slots 328, 330, 332, 334, 336, and 338 have a pair of planar coupling slots (328, 330, 332, 334, 336, and 338) that are spaced 340 approximately a quarter-wavelength apart. In this example, the planar coupling slots are radiating slots that radiate energy out from the feed waveguide 300. It is appreciated that the feed waveguide 300 is constructed of a conductive material such as metal and defines a rectangular tube that that has an internal cavity running the length 342 of the feed waveguide 300 that may be filled with air, dielectric material, or both.

In an example of operation, when the first input signal 344 and second input signals 346 are injected (i.e., inputted) into the feed waveguide 300 they excite both magnetic and electric fields within the feed waveguide 300. This gives rise to induced currents in the walls (i.e., the broad-wall 302 and narrow wall (not shown)) of feed waveguide 300 that are at right angles to the magnetic field. As an example, in FIG. 4A, a perspective-side view of a portion 400 of the feed waveguide 300 (of FIG. 3) is shown. In this example, the first input signal 402 is injected into the cavity 404 of the feed waveguide 300 at the first feed waveguide input 406 (at the first end 408 of the feed waveguide 300). If the first input signal 402 is a $TE_{10}$ mode signal, it will induce an electric field 410 that is directed along the vertical direction of the narrow-wall 412 of the feed waveguide 300 and a magnetic field 414 that is perpendicular to the electric field 410 and forms loops along the direction of propagation 416, which are parallel to the top 302 and bottom 418 broad-walls and tangential to the sidewalls (i.e., narrow-wall 412). It is appreciated that for the $TE_{10}$ mode, the electric field 410 varies in a sinusoidal fashion as a function of distance along the direction of propagation. In FIG. 4B, a perspective-side view of a portion 400 of the feed waveguide 300 (of FIG. 3) is shown with the resulting induced currents 420 in the $TE_{10}$ mode along the broad-wall 302 and narrow-wall 412 that produced by the first input signal 402. Expanding on this concept, in FIG. 5, a top view of the feed waveguide 500 is shown with a plurality of excited magnetic field loops along the length of the feed waveguide 500. The magnetic field loops are caused by the propagation of the first input signal 344 along the length of the feed waveguide 500.

Figure 4A:
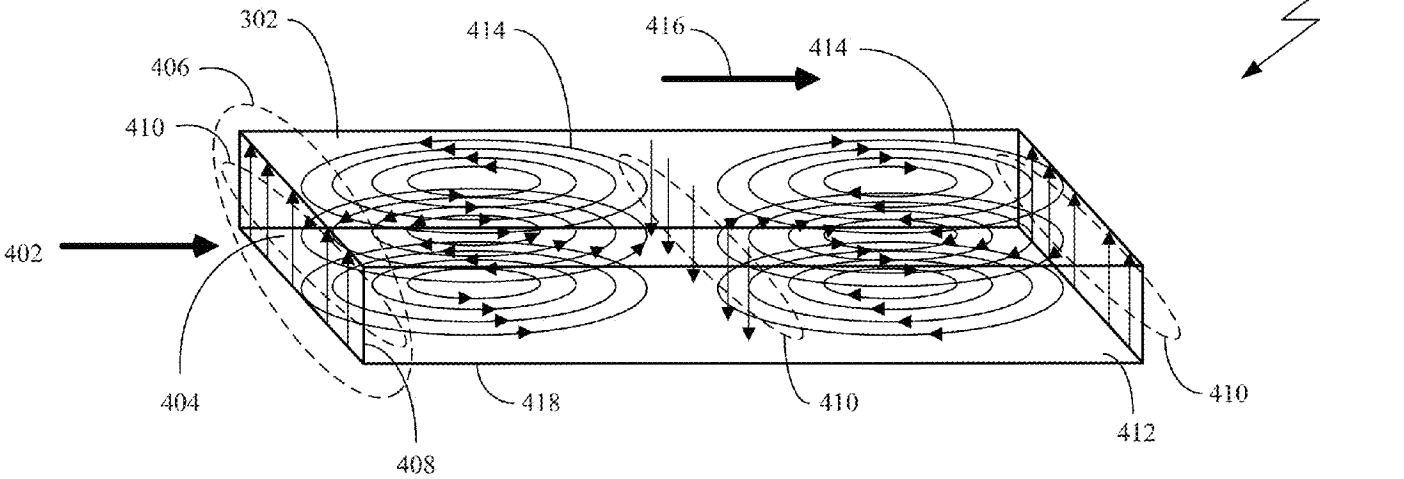
FIG. 4A is a perspective-side view of a portion of the feed waveguide shown in FIG. 3 showing the $TE_{10}$ mode excited electric and magnetic fields.
Figure 4B:
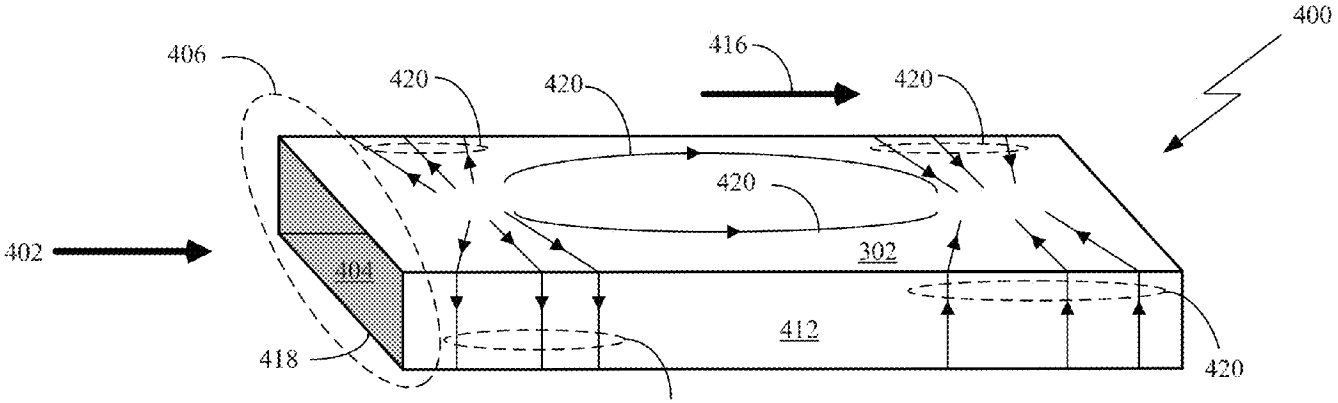
FIG. 4B is a perspective-side view of a portion of the feed waveguide shown in FIG. 3 showing the resulting induced currents in the $TE_{10}$ mode along the broad-wall and narrow-wall corresponding to the excited electric and magnetic fields shown in FIG. 4A.
Figure 5:
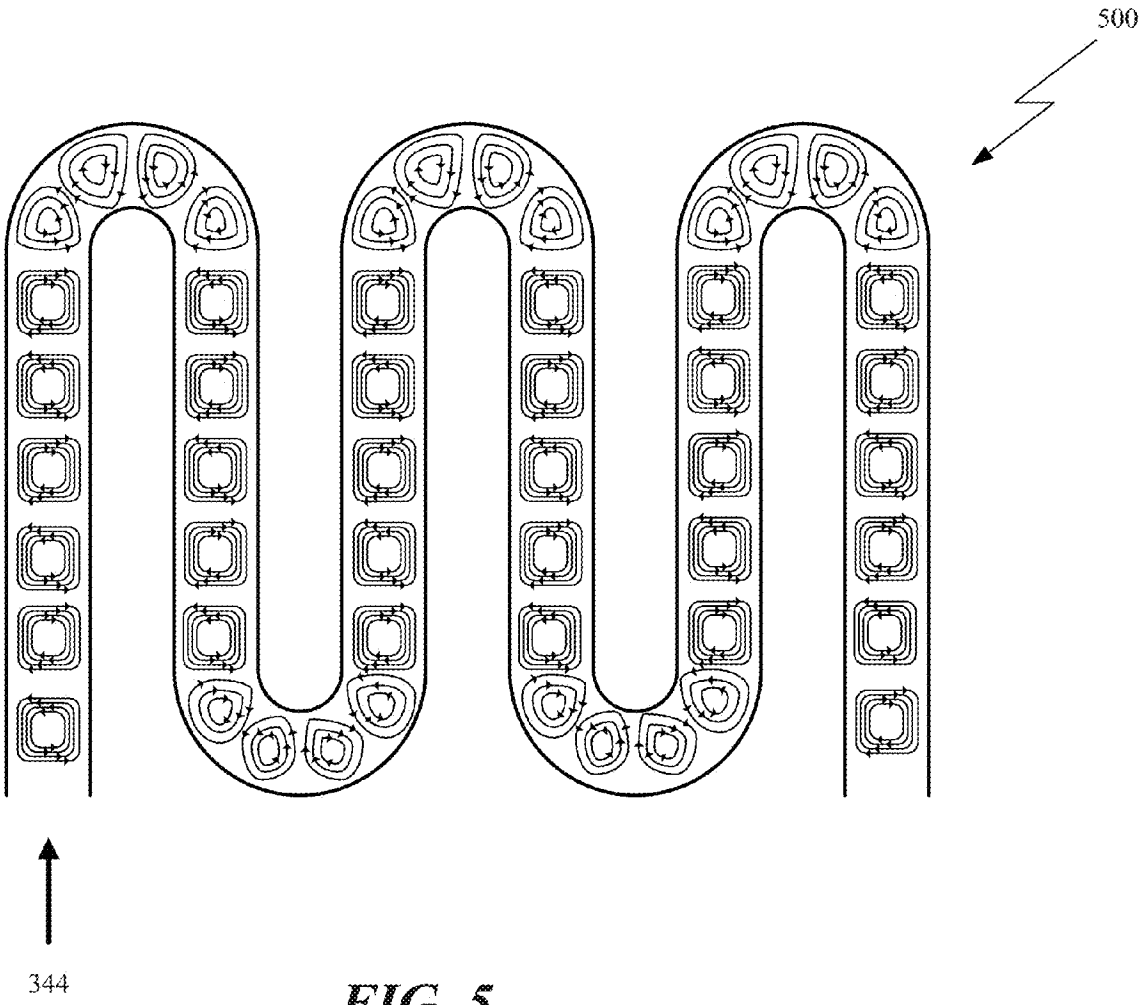
FIG. 5 is a top view of the feed waveguide shown if FIG. 3 with a plurality of excited magnetic field loops along the length of the feed waveguide.

It is noted that in FIGS. 4A, 4B, and 5 the examples were described in relation to the first input signal (344 and 402); however, it is appreciated that by reciprocity the same examples hold true for describing the electric and magnetic fields and the induced currents along the feed waveguide (300 and 500) for the second input signal 346. The only difference is that the polarities will be opposite because of the opposite direction of propagation of the second input signal 346 in relation to the first input signal (344 and 402).

Turning back to FIG. 3 (with reference to FIGS. 4A and 4B), each planar coupling slot 304, 306, 308, 310, 312, 314, 316, 318, 320, 322, 324, and 326 is designed to interrupt the current flow of the induced currents 420 in the broad-wall 302 of the feed waveguide 300 and as a result produce a disturbance of the internal electric 410 and magnetic 414 fields that results in energy being radiated from the cavity 404 of the feed waveguide 300 to the external environment of the feed waveguide 300, i.e., coupling energy from the feed waveguide 300 to the external environment. Turning back to FIGS. 1A through 1D and FIG. 2, these pairs of pairs of planar coupling slots 328, 330, 332, 334, 336, and 338, couple energy from the feed waveguide 300 to the respective directional couplers shown in FIGS. 1A through 1D and FIG. 2.

It is appreciated by those skilled in the art that FIGS. 4A, 4B, and 5 describe the input signals as being $TE_{10}$ mode signals; however, the signals may instead be $TE_{01}$ mode signals which are also well known to those skilled in the art. In the case of $TE_{10}$ mode signals, the induced currents and electric fields within the feed waveguide (300 and 500) will be different and each planar coupling slot will be different than the slots for the $TE_{10}$ mode example described above. However, the design theory is similar in that each planar coupling slot is still designed to interrupt the current flow of induced currents in the broad-wall of the feed waveguide.

Figure 6:
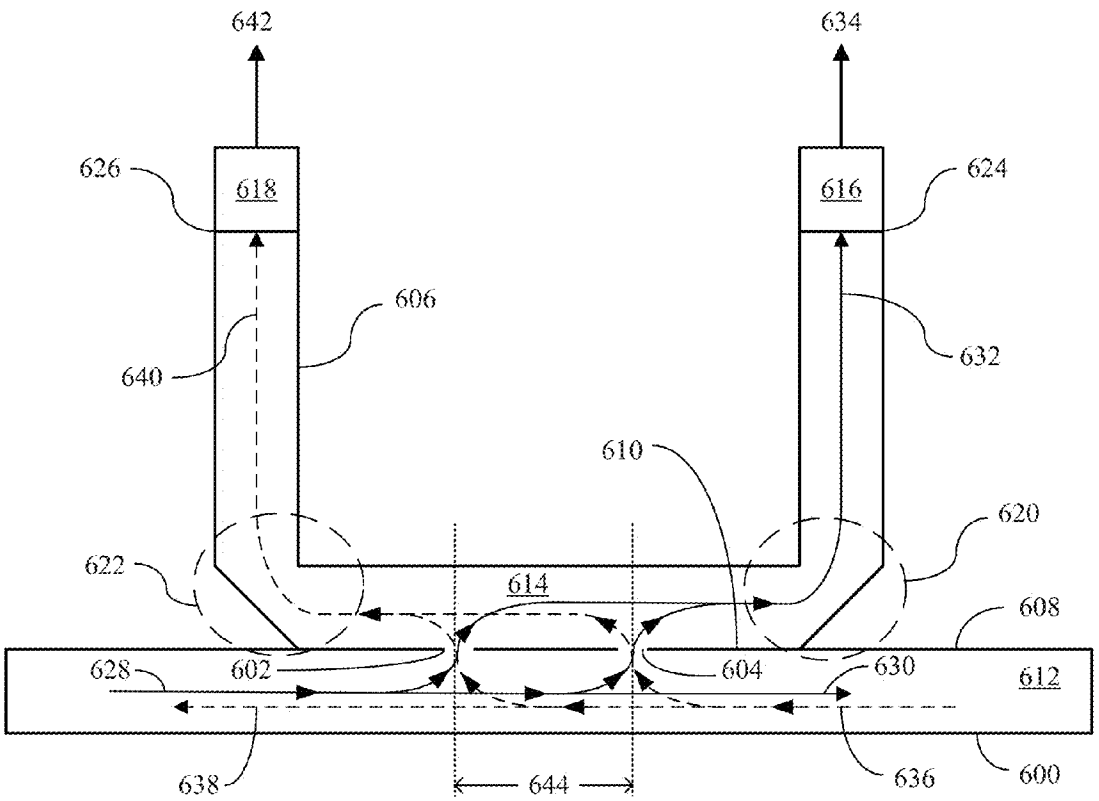
FIG. 6 is a side-cut view of an example of implementation of the feed waveguide, pair of planar coupling slots, and directional coupler in accordance with the present invention.

Turning to FIG. 6, in FIG. 6 a side-cut view of an example of implementation of the feed waveguide 600, pair of planar coupling slots 602 and 604, and directional coupler 606 is shown in accordance with the present invention. The directional coupler 606 is coupled to the feed waveguide 600 via the pair of planar coupling slots 602 and 604, which couple energy from the feed waveguide 600 to the directional coupler 606. In this example, it is appreciated that the feed waveguide 600 has a pair of planar coupling slots cut into the top broad-wall 608 of the feed waveguide 600 and that the directional coupler has a corresponding pair of planar coupling slots cut into the bottom broad-wall 610 of the directional coupler 606. The pair of planar coupling slots from the feed waveguide 600 and the pair of planar coupling slots from the directional coupler 606 are placed on top of each other to form the combined pair of planar coupling slots 602 and 604 that allow energy to be coupled from the cavity 612 inside the feed waveguide 600 to a cavity 614 inside the directional coupler. The directional coupler 606 is in signal communication with a first power amplifier 616 and a second power amplifier 618. Similar to the direction coupler 150 shown in FIG. 1C, the directional coupler 606 is shown to be a "U" shaped waveguide structure that is located adjacent the feed waveguide 600 having two bends 620 and 622. The first bend 620 is located close to the first power amplifier 616 and the second bend 622 is located in the opposite direction along the directional coupler 606 close to the second power amplifier 618. Specifically, the directional coupler 606 is in signal communication with the both power amplifiers 616 and 618 at a directional coupler first end 624 and second end 626, respectively. In this example, the first bend 620 and second bend 622 are shown to be a non-step transition bend, unlike the bends 166 and 168 shown in FIG. 1C. As discussed earlier, there a various types of known of E-bends that may be utilized in the directional coupler is based on the design goals of the antenna array system.

In an example of operation, a first signal 628 (corresponding to the first input signal) is propagating along the feed waveguide 600. When the first signal 628 reaches the pair of planar coupling slots 602 and 604, most of the power will continue to propagate along the feed waveguide 600 as shown by remaining first input signal 630; however, a small part of the first signal 628 will be coupled from the feed waveguide 600 to the directional coupler 606 via the pair of planar coupling slots 602 and 604. This coupled energy is shown as forward coupled signal 632. The forward coupled signal 632 is then passed to the first power amplifier 616, which amplifies the amplitude of the signal and passes the amplified first coupled signal 634 to an input feed of a horn antenna (not shown).

Similarly, a second signal 636 (corresponding to the second input signal) is propagating along the feed waveguide 600 in the opposite direction of the first signal 628. When the second signal 636 reaches the pair of planar coupling slots 602 and 604, most of the power will continue to propagate along the feed waveguide 600 as shown by remaining second input signal 638; however, a small part of the second signal 636 will be coupled from the feed waveguide 600 to the directional coupler 606 via the pair of planar coupling slots 602 and 604. This coupled energy is shown as reverse coupled signal 640. The reverse coupled signal 640 is then passed to the second power amplifier 618, which amplifies the amplitude of the signal and passes the amplified second coupled signal 642 to another input feed of the horn antenna. The horn antenna may then utilize the amplified first coupled signal 634 to produce and radiate a RHCP signal and the amplified second coupled signal 642 to produce and radiate a LHCP signal. Alternatively, the horn antenna may then utilize the amplified first coupled signal 634 to produce and radiate a horizontal polarized signal and the amplified second coupled signal 642 to produce and radiate a vertical polarized signal.

In this example, the pair of planar coupling slots 602 and 604 are spaced 644 apart by approximately a quarter-wavelength. The reason for a quarter-wavelength spacing is well known in the art for directional couplers but may be generally stated as causing the first signal 628 to couple energy from the feed waveguide 600 to the directional coupler 6096 in one direction while causing the second signal 636 to couple energy from the feed waveguide 600 to the directional coupler 606 in the opposite direction. The reason for this is that in general coupled signal propagate in both directions, however, the phase delay caused by the planar coupling slots 602 and 604 will cause one of the coupled signals to cancel in one direction while adding phases in another. Specifically, when the first signal 628 reaches the first planar coupling slot 602, part of the energy (i.e., a coupled signal) from the first signal 628 will couple into the directional coupler 606 via the first planar coupling slot 602. When the remaining first signal reaches the second planar coupling slot 604, another part of the energy from the remaining first signal will couple into the directional coupler 606 via the second planar coupling slot 604. Since these two coupled signals are propagating in the same direction (i.e., towards the first power amplifier 616), they are in-phase and constructively add in phase to produce the forward coupled signal 632. However, any energy coupled in the opposite direction (i.e., towards the second power amplifier 618) will constructively cancel out because the coupled signal (produced by the first planar coupling slot 602) from the first signal 628 traveling towards the second power amplifier 618 will lead the coupled signal (produced by the second planar coupling slot 604) from the remaining first signal by approximately 180 degrees in phase. This results because, taking the first planar coupling slot 602 as a reference, the coupled signal going to the second planar coupling slot 604 has to travel a further quarter-wavelength in the feed waveguide 600, and then quarter-wavelength back again in the directional coupler 606. Hence the two coupled signals in the direction of the second power amplifier 618 cancel each other. It is appreciated that in practice a small amount of power (i.e., energy) will reach the second power amplifier 618 because of the imperfections in designing the directional coupler 606. However, this may be minimized by proper design techniques that are known to those skilled in the art. It is appreciated that the same coupling process is applicable to the second signal 636 such that the reverse coupled signal 640 is result of constructive addition, while a coupled signals from the second signal 636 in the direction of the first power amplifier 616 is cancelled.

Figure 7A:
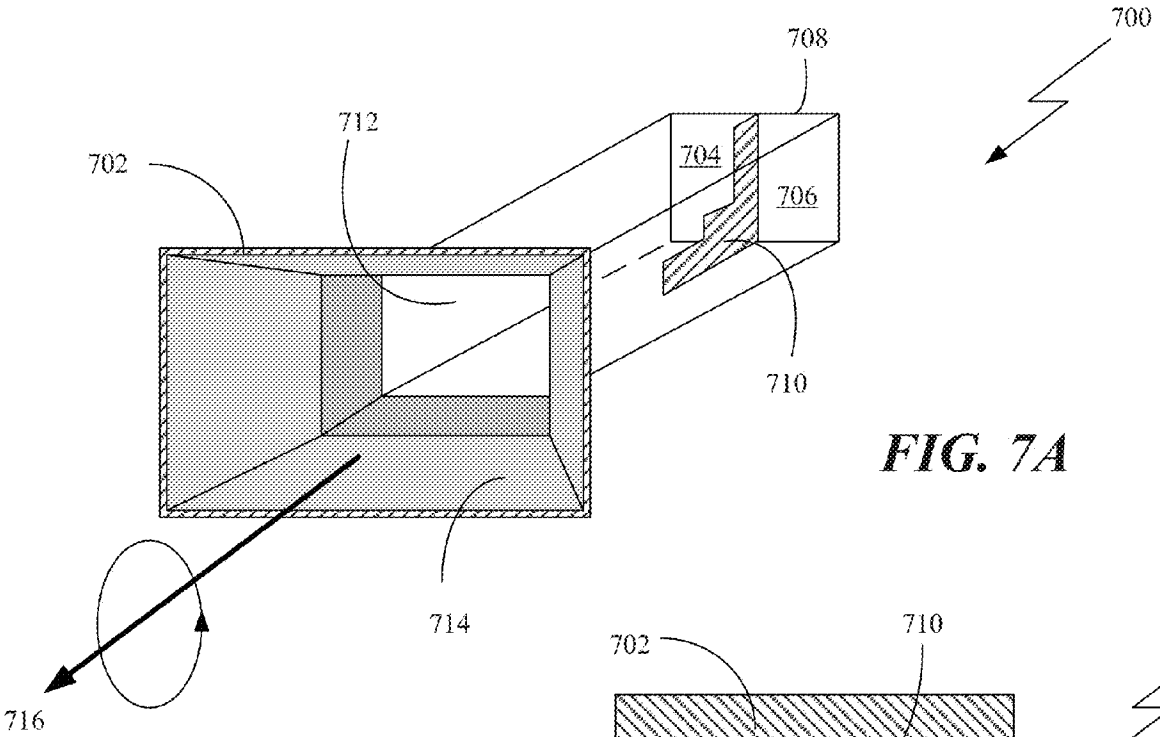
FIG. 7A is a front-perspective view of an example of an implementation of a horn antenna for use with the antenna array system in accordance with the present invention.

In FIG. 7A, a front-perspective view of an example of an implementation of a horn antenna 700 for use with the antenna array system is shown in accordance with the present invention. In general, the horn antenna 700 is an antenna that consists of a flaring metal 702 waveguide shaped like a horn to direct radio waves in a beam.

Figure 7B:
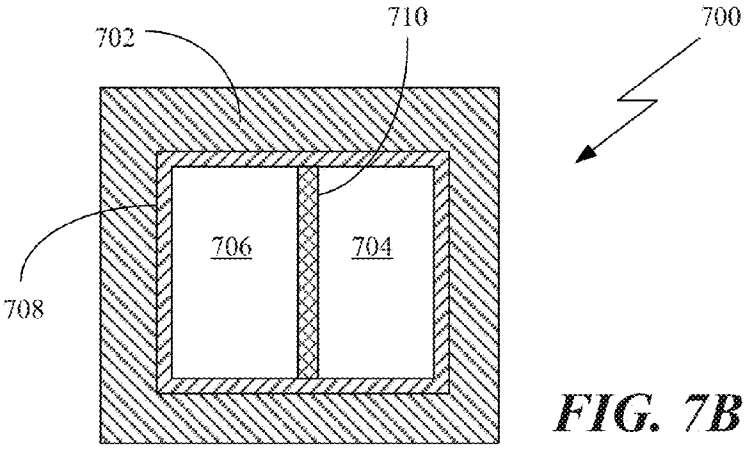
FIG. 7B is a back view of the horn antenna (shown in FIG. 7A) showing a first horn input, a second horn input, and a septum polarizer.

In this example, the horn antenna 700 includes a first horn input 704 and a second horn input 706 at the feed input 708 of the horn antenna 700. In this example, the horn antenna 700 includes a septum polarizer 710. It is appreciated by those skilled in the art that a septum polarizer 710 is a waveguide device that is configured to transform a linearly polarized signal at the first horn input 704 and second horn input 706 into a circularly polarized signal at the output 712 of the waveguide into the horn antenna aperture 714. The horn antenna 700 then radiates a circularly polarized signal 716 into free space. FIG. 7B is a back view of the horn antenna 700 showing the first horn input 704, a second horn input 706, and septum polarizer 710. In this example, the horn antenna 700 is shown to be a septum horn but the horn antenna 700 may also be another type of horn antenna based on the required design parameters of the antenna array system. Examples of other types of horn antennas that may be utilized as a horn antenna 700 include, for example, a pyramidal horn, conical horn, exponential horn, and ridged horn.

In an example of operation, linear signals feed into the first horn input 704 may be transformed into RHCP signals at the output 712 of the waveguide, while linear signals feed into the second horn input 706 may be transformed into LHCP signals at the output 712 of the waveguide. The RHCP or LHCP signals may then be transmitted as the circularly polarized signal 716 into free space.

Alternatively, a different horn antenna design may be utilized that produces linear polarization signals, instead of circularly polarized signals, from the linear signals feed into the first horn input (not shown) and the second horn input (not shown). Vertical and horizontal polarized signals, instead of RHCP and LHCP signals, may then be transmitted into free space. In this example an orthomode transducer ("OMT") may be utilized at each element rather than a septum polarizer.

Figure 8:
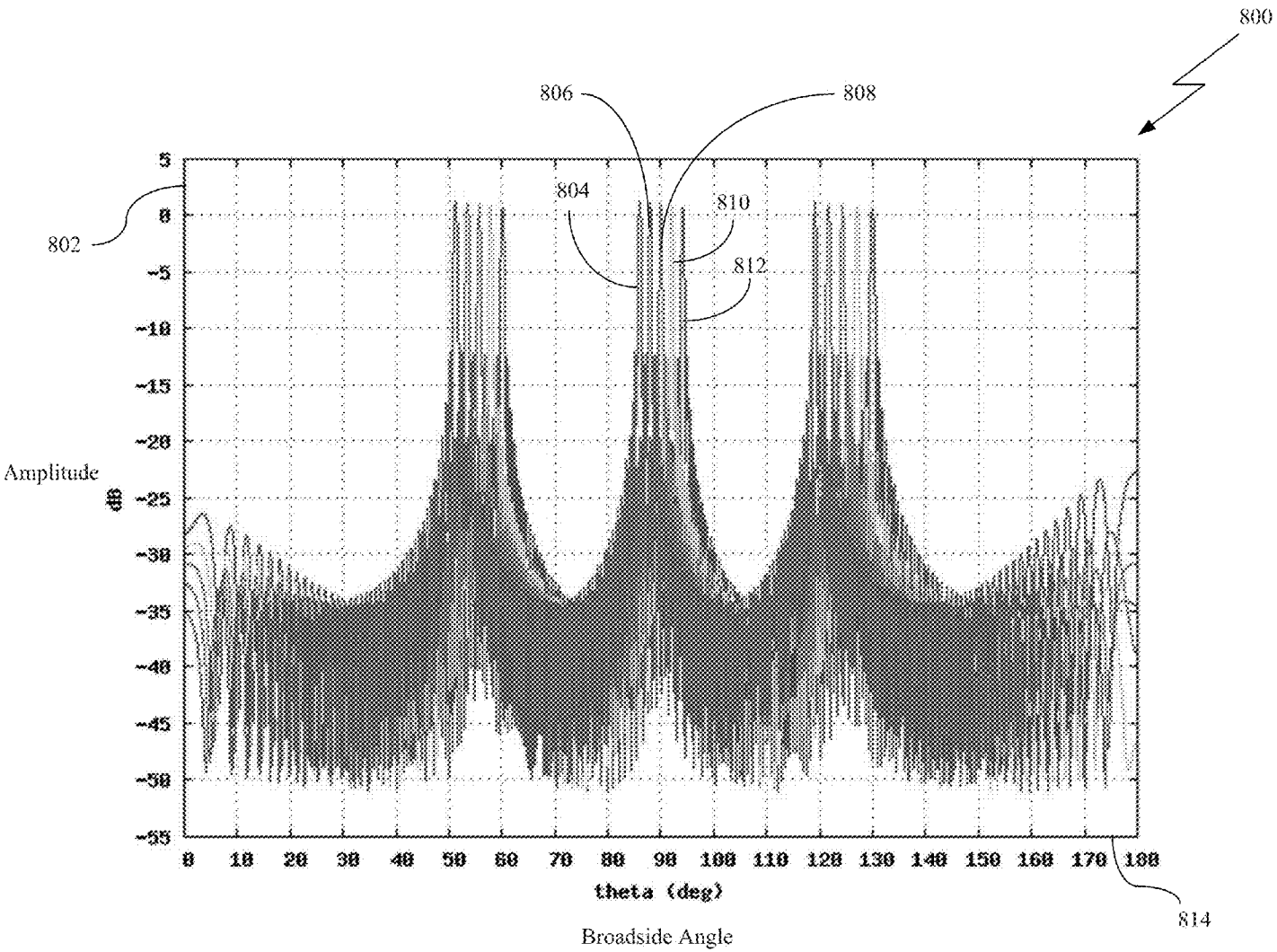
FIG. 8 is a plot of the amplitude, in decibels, of five example antenna radiation patterns versus broadside angle in degrees.

In FIG. 8, a plot 800 of the amplitude in decibels ("dB") 802 of five example antenna radiation patterns 804, 806, 808, 810, and 812 versus broadside angle in degrees 814. The antenna radiation patterns 804, 806, 808, 810, and 812 are for an example 60 element antenna array system versus frequency. As an example, the first plot 804 is an antenna beam pattern at 19.7 GHz, the second plot 806 is an antenna beam pattern at 19.825 GHz, the third plot 808 is an antenna beam pattern at 19.95 GHz, the fourth plot 810 is an antenna beam pattern at 20.075 GHz, and the fifth plot 812 is an antenna beam pattern at 20.2 GHz.

Figure 9A:
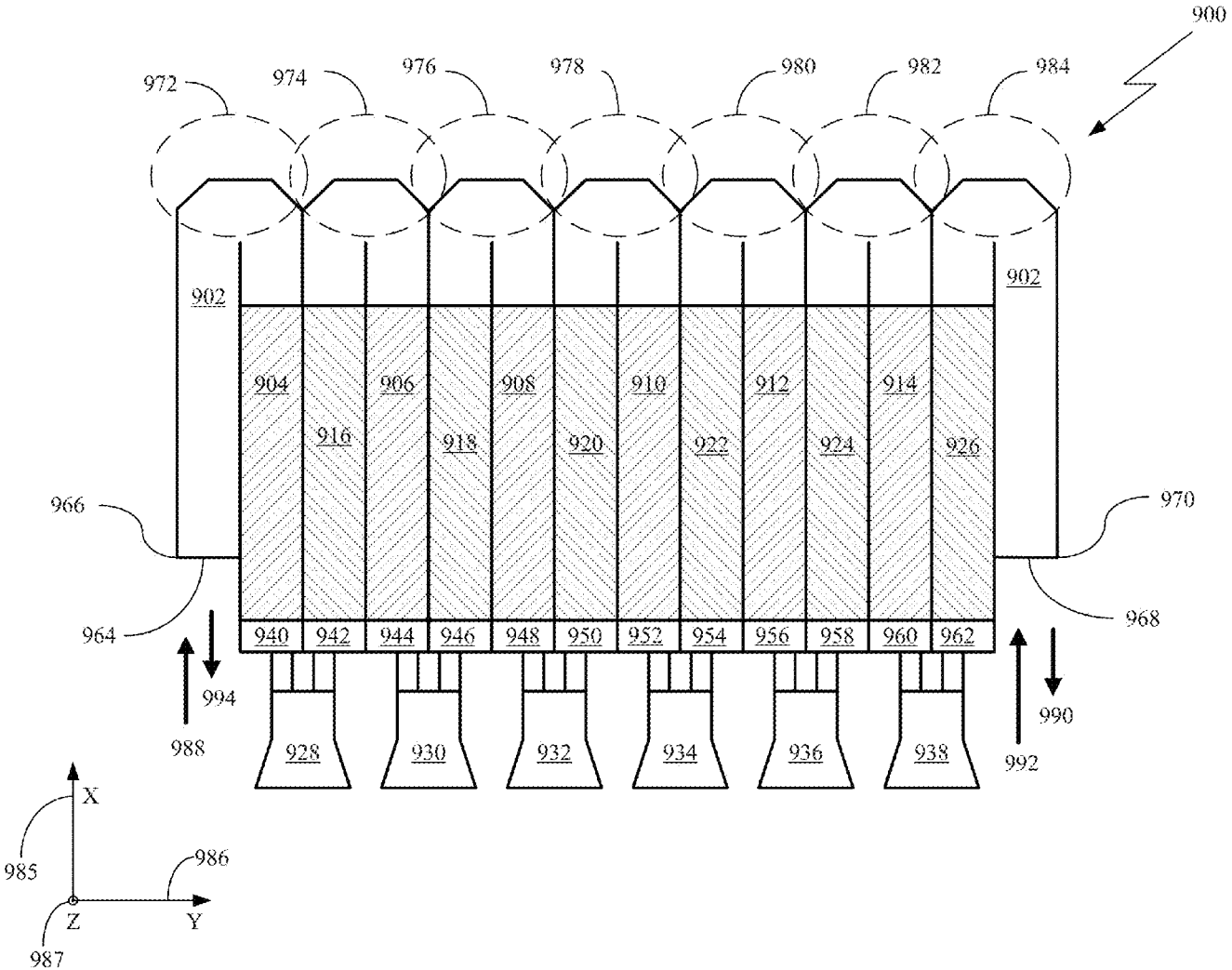
FIG. 9A is a top view of the example of the implementation of another antenna array system in accordance with the present invention.
Figure 9B:
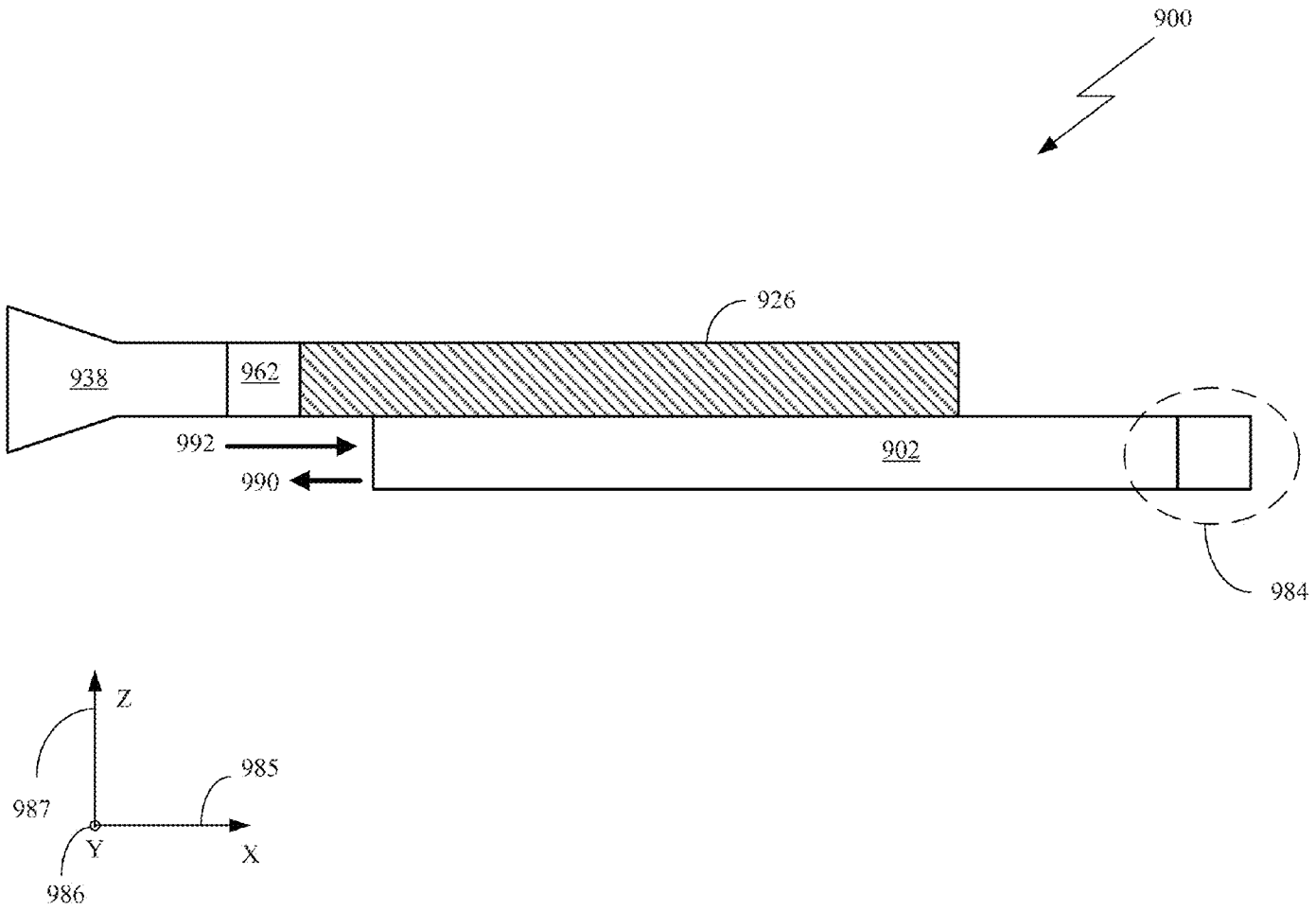
FIG. 9B is a side view of the example of the implementation of an antenna array system shown in FIG. 9A.

Turning to FIGS. 9A and 9B, various views of an example of another implementation of an antenna array system 900 are shown in accordance with the present invention. In FIG. 9A, a top view of the example of the implementation of another antenna array system 900 is shown. The antenna array 900 may include a feed waveguide 902, a plurality of forward directional couplers 904, 906, 908, 910, 912, and 914, a plurality of reverse directional couplers 916, 918, 920, 922, 924, and 926, a plurality of horn antennas 928, 930, 932, 934, 936, and 938, and a plurality of power amplifiers 940, 942, 944, 946, 948, 950, 952, 954, 956, 958, 960, and 962. In this example, the feed waveguide 902 is in signal communication with the both the plurality of forward directional couplers 904, 906, 908, 910, 912, and 914 and the plurality of reverse directional couplers 916, 918, 920, 922, 924, and 926. The forward directional couplers 904, 906, 908, 910, 912, and 914 are respectively in signal communication with the power amplifiers 940, 944, 948, 952, 956, and 960. Similarly, the reverse directional couplers 916, 918, 920, 922, 924, and 926 are respectively in signal communication with the power amplifiers 942, 946, 950, 954, 958, and 962. The horn antenna 928 is in signal communication with the two power amplifiers 940 and 942. The horn antenna 930 is in signal communication with the two power amplifiers 944 and 946. The horn antenna 932 is in signal communication with the two power amplifiers 948 and 950. The horn antenna 934 is in signal communication with the two power amplifiers 956 and 958. Finally, the horn antenna 938 is in signal communication with the two power amplifiers 960 and 962.

The feed waveguide 902 includes a first feed waveguide input 964 at a first end 966 of the feed waveguide 902 and a second feed waveguide input 968 at a second end 970 of the feed waveguide 902, where the second end 970 is at the opposite end of the feed waveguide 902 with respect to the first end 966. The feed waveguide 902 may be a serpentine or meandering waveguide that includes a plurality of turns (i.e., bends) 972, 974, 976, 978, 980, 982, and 984. In this example, the physical layout of the feed waveguide 902 may be described by three-dimensional Cartesian coordinates with coordinate axes X 985, Y 986, and Z 987, where the feed waveguide 902 is located in a plane defined by the X 985 and Y 986 coordinate axes. Additionally, the plurality of horn antennas 928, 930, 932, 934, 936, and 938 are also shown extending in the plane defined by the X 985 and Y 986 coordinate axes.

Again, it is appreciated by those skilled in the art, that while only six horn antennas 928, 930, 932, 934, 936, and 938 and seven visible turns 972, 974, 976, 978, 980, 982, and 984, and six none visible turns in the feed waveguide 902 are shown, this is for illustration purposes only and antenna array system 900 may include any even number of directional couplers, horn antennas, and power amplifiers with a corresponding number of turns needed to feed the directional couplers. As another example, the antenna array system 900 may include 120 directional couplers and 60 horn antennas, and 121 turns in the feed waveguide. It is again appreciated that the number of horn antennas determines the numbers directional couplers, and turns in the feed waveguide. Again, each horn antenna of the plurality of horn antennas 928, 930, 932, 934, 936, and 938 act as an individual radiating element of the antenna array system 900. In operation, each horn antenna's individual radiation pattern typically varies in amplitude and phase from each other horn antenna's radiation pattern. The amplitude of the radiation pattern for each horn antenna is controlled by a power amplifier that controls the amplitude of the excitation current of the horn antenna. Similarly, the phase of the radiation pattern of each horn antenna is determined by the corresponding delayed phase caused by the feed waveguide 902 in feeding the directional couplers that correspond to the horn antenna.

In FIG. 9B, a side view of the example of the implementation of an antenna array system 900 is shown. For reference, the physical layout of the antenna array system 900 in this side view is shown within a plane defined by the X 985 and Z 987 coordinate axes with the Y 986 coordinate axis directed in a direction that is both perpendicular and out of the X 985 and Z 987 defined plane. In this side view, the reverse directional coupler 926 is shown to be a rectangular waveguide structure that is located adjacent the feed waveguide 902. Specifically, the reverse directional coupler 926 is in signal communication with the horn antenna 938 through the power amplifier 962.

In an example of operation, when a first input signal 988 in injected into the first feed waveguide input 964, the first input signal 988 will travel along the feed waveguide 902 and couple a first portion of its energy to the forward directional coupler 904, which will pass this first coupled output signal to the horn antenna 928 via the power amplifier 940. The remaining portion of the first input signal will then travel along the feed waveguide 902 to the reverse directional coupler 916 where it will not couple any energy because the reverse direction coupler 916 is designed to only couple signals that are traveling in the opposite direction. As such, the remaining portion of the first input signal will continue to travel along the feed waveguide 902 to the forward directional coupler 906 and couple a second portion of its energy to the forward directional coupler 906, which will pass this second coupled output signal to the horn antenna 930 via the power amplifier 944. The remaining portion of the first input signal will then travel along the feed waveguide 902 to the reverse directional coupler 918 where it will not couple any energy because the reverse direction coupler 918 is designed to only couple signals that are traveling in the opposite direction. As such, the remaining portion of the first input signal will continue to travel along the feed waveguide 902 to the forward directional coupler 908 and couple a third portion of its energy to the forward directional coupler 908, which will pass this third coupled output signal to the horn antenna 932 via the power amplifier 948. The remaining portion of the first input signal will then travel along the feed waveguide 902 to the reverse directional coupler 920 where it will not couple any energy because the reverse direction coupler 920 is designed to only couple signals that are traveling in the opposite direction. As such, the remaining portion of the first input signal will continue to travel along the feed waveguide 902 to the forward directional coupler 910 and couple a fourth portion of its energy to the forward directional coupler 910, which will pass this fourth coupled output signal to the horn antenna 934 via the power amplifier 952. The remaining portion of the first input signal will then travel along the feed waveguide 902 to the reverse directional coupler 922 where it will not couple any energy because the reverse direction coupler 922 is designed to only couple signals that are traveling in the opposite direction. As such, the remaining portion of the first input signal will continue to travel along the feed waveguide 902 to the forward directional coupler 912 and couple a fifth portion of its energy to the forward directional coupler 912, which will pass this fifth coupled output signal to the horn antenna 936 via the power amplifier 956. The remaining portion of the first input signal will then travel along the feed waveguide 902 to the reverse directional coupler 924 where it will not couple any energy because the reverse direction coupler 924 is designed to only couple signals that are traveling in the opposite direction. As such, the remaining portion of the first input signal will continue to travel along the feed waveguide 902 to the forward directional coupler 914 and couple a sixth portion of its energy to the forward directional coupler 914, which will pass this sixth coupled output signal to the horn antenna 938 via the power amplifier 960. The remaining portion of the first input signal will then travel along the feed waveguide 902 to the reverse directional coupler 926 where it will not couple any energy because the reverse direction coupler 926 is designed to only couple signals that are traveling in the opposite direction. As such, the remaining portion of the first input signal will continue to travel along the feed waveguide 902 and output, as the first remaining signal 990, via the second feed waveguide input 968. It is appreciated that by optimizing the design of forward directional couplers 904, 906, 908, 910, 912, and 914, the first remaining signal 990 may be reduced to close to zero.

Similarly, when a second input signal 992 is in injected into the second feed waveguide input 968, the second input signal 992 will travel along the feed waveguide 902 (in the opposite direction of the first input signal 988) and couple a first portion of its energy to the reverse directional coupler 926, which will pass this first coupled output signal to the horn antenna 938 via the power amplifier 962. The remaining portion of the second input signal will then travel along the feed waveguide 902 to the forward directional coupler 914 where it will not couple any energy because the forward direction coupler 914 is designed to only couple signals that are traveling in the opposite direction (i.e., the direction of the first input signal 988). As such, the remaining portion of the second input signal will continue to travel along the feed waveguide 902 to the reverse directional coupler 924 and couple a second portion of its energy to the reverse directional coupler 924, which will pass this second coupled output signal to the horn antenna 936 via the power amplifier 958. The remaining portion of the second input signal will then travel along the feed waveguide 902 to the forward directional coupler 912 where it will not couple any energy because the forward directional coupler 912 is designed to only couple signals that are traveling in the opposite direction. As such, the remaining portion of the second input signal will continue to travel along the feed waveguide 902 to the reverse directional coupler 922 and couple a third portion of its energy to the reverse directional coupler 922, which will pass this third coupled output signal to the horn antenna 934 via the power amplifier 954. The remaining portion of the second input signal will then travel along the feed waveguide 902 to the forward directional coupler 910 where it will not couple any energy because the forward directional coupler 910 is designed to only couple signals that are traveling in the opposite direction. As such, the remaining portion of the second input signal will continue to travel along the feed waveguide 902 to the reverse directional coupler 920 and couple a fourth portion of its energy to the reverse directional coupler 920, which will pass this fourth coupled output signal to the horn antenna 932 via the power amplifier 950. The remaining portion of the second input signal will then travel along the feed waveguide 902 to the forward directional coupler 908 where it will not couple any energy because the forward directional coupler 908 is designed to only couple signals that are traveling in the opposite direction. As such, the remaining portion of the second input signal will continue to travel along the feed waveguide 902 to the reverse directional coupler 918 and couple a fifth portion of its energy to the reverse directional coupler 918, which will pass this fifth coupled output signal to the horn antenna 936 via the power amplifier 946. The remaining portion of the second input signal will then travel along the feed waveguide 902 to the forward directional coupler 906 where it will not couple any energy because the forward directional coupler 906 is designed to only couple signals that are traveling in the opposite direction. As such, the remaining portion of the second input signal will continue to travel along the feed waveguide 902 to the reverse directional coupler 916 and couple a sixth portion of its energy to the reverse directional coupler 916, which will pass this sixth coupled output signal to the horn antenna 928 via the power amplifier 942. The remaining portion of the second input signal will then travel along the feed waveguide 902 to the forward directional coupler 904 where it will not couple any energy because the forward directional coupler 904 is designed to only couple signals that are traveling in the opposite direction. As such, the remaining portion of the second input signal will continue to travel along the feed waveguide 902 and output, as the second remaining signal 992, via the first feed waveguide input 964. Again, it is appreciated that by optimizing the design of reverse directional couplers 916, 918, 920, 922, 924, and 926, the second remaining signal 994 may be reduced to close to zero.

Again, it is appreciated that a first circulator, or other isolation device, (not shown) may be connected to the first end 966 to isolate the first input signal 988 from the outputted second remaining signal 994 and a second circulator, or other isolation device, (not shown) may be connected to the second end 970 to isolate the second input signal 992 from the outputted first remaining signal 990. It is also appreciated by those skilled in the art that the amount of coupled energy from the feed waveguide 902 to the respective directional couplers 904, 906, 908, 910, 912, 914, 916, 918, 920, 922, 924, and 926 is determined by predetermined design choices that will yield the desired radiation antenna pattern of the antenna array system 900.

Figure 10:
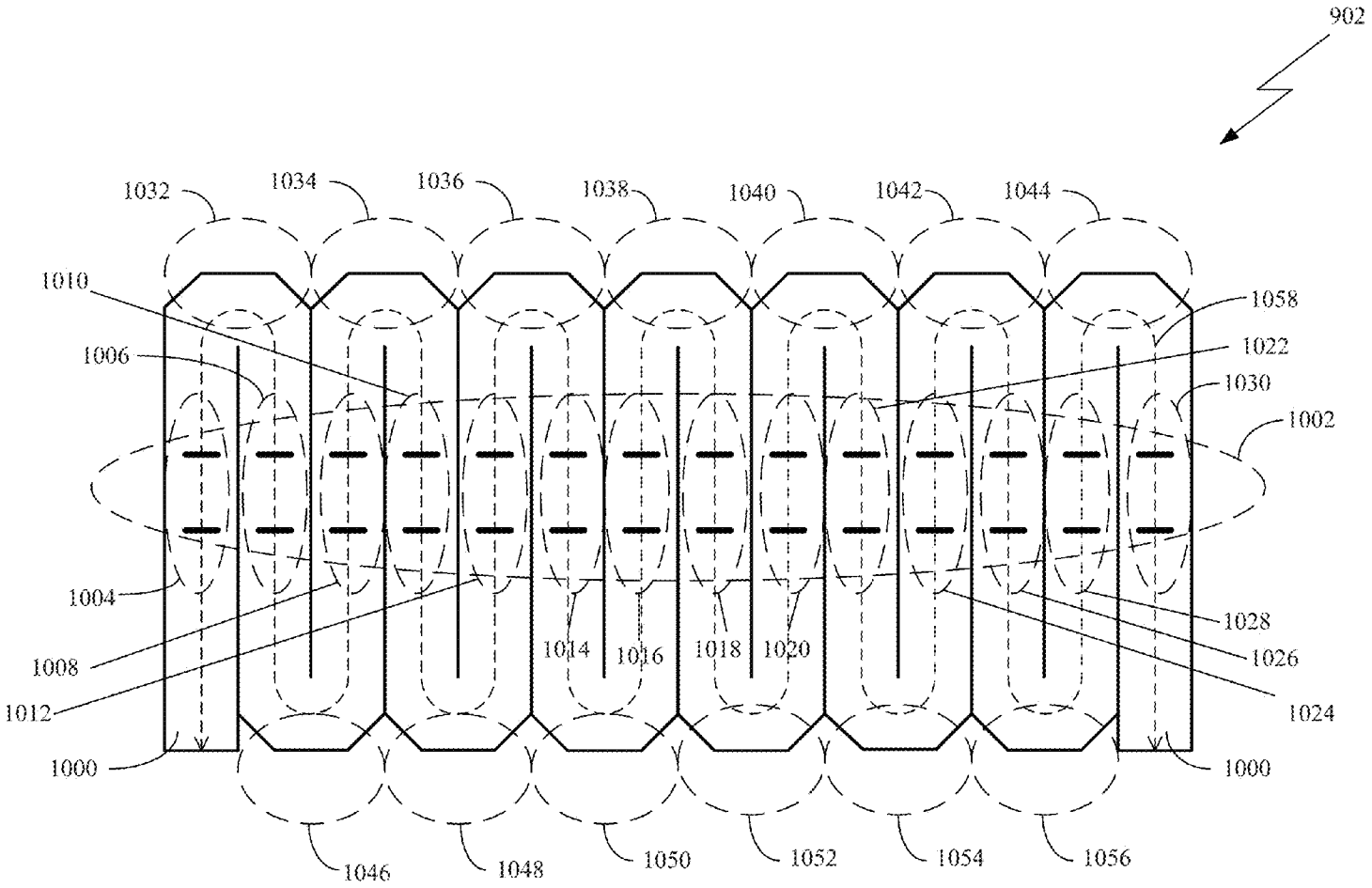
FIG. 10 is a top view of an example of an implementation of the feed waveguide (shown if FIGS. 9A and 9B) in accordance with the present invention.

Turning to FIG. 10, a top view of an example of an implementation of the feed waveguide 902 (of FIGS. 9A and 9B) is shown in accordance with the present invention. The feed waveguide 902 includes a broad-wall 1000 and a plurality of planar coupling slots 1002 that are organized into pairs of planar coupling slots 1004, 1006, 1008, 1010, 1012, 1014, 1016, 1018, 1020, 1022, 1024, 1026, 1028, and 1030, respectively. In this example, the planar coupling slots are cut into the broad-wall 1000 of the feed waveguide 902 and each pair of planar coupling slots 1004, 1006, 1008, 1010, 1012, 1014, 1016, 1018, 1020, 1022, 1024, 1026, 1028, and 1030 have a spacing between pairs of planar coupling slots that is approximately equal to a quarter-wavelength of the operating wavelength of the antenna array system 900. Also in this example, the feed waveguide 902 may include 13 H-bends 1032, 1034, 1036, 1038, 1040, 1042, 1044, 1046, 1048, 1050, 1052, 1054, and 1056. Again, the feed waveguide 902 may be constructed of a conductive material such as metal and defines a rectangular tube that that has an internal cavity running the length 1058 of the feed waveguide 902 that may be filled with air, dielectric material, or both. It is noted that unlike the feed waveguide 102, 300, 500, and 600 (shown in FIGS. 1A, 3, 5, and 6), the feed waveguide 902 (shown in FIG. 9) is has non-continuous turns 1032, 1034, 1036, 1038, 1040, 1042, 1044, 1046, 1048, 1050, 1052, 1054, and 1056 and 12 common narrow-walls between the straight paths of the feed waveguide 902; however, it is appreciated that the feed waveguide 902 may be designed to couple energy to the directional couplers 904, 906, 908, 910, 912, 914, 916, 918, 920, 922, 924, and 926 in substantially the same way that the feed waveguide 102 (in FIGS. 1B, 1C, and 1D) may be designed to couple energy to the directional couplers 140, 142, 144, 146, 148, and 150 utilizing the principles described previously.

The difference between the first implementation of the antenna array system 100 shown in FIGS. 1-6 and the second implementation of the antenna array system 900 is that the second implementation requires twice as many directional couplers. In the second implementation, the directional couplers 904, 906, 908, 910, 912, 914, 916, 918, 920, 922, 924, and 926 can only pass coupled signals to the horn antennas 928, 930, 932, 934, 936, and 938 if the traveling signal in the feed waveguide 902 is traveling in the correct direction. As such, the directional couplers 904, 906, 908, 910, 912, and 914 that are configured to pass the first input signal 988 to the horn antennas 928, 930, 932, 934, 936, and 938 are referred to as forward directional couplers, while the directional couplers 916, 918, 920, 922, 924, and 926 that are configured to pass the second input signal 992 to the horn antennas 928, 930, 932, 934, 936, and 938 are referred to as reverse directional couplers.

In the first implementation, each directional coupler 140, 142, 144, 146, 148, and 150 is designed to couple signals from both the first input signal 184 and second input signal 186 irrespective of the direction of travel. Both coupled signals are passed to the respective horn antenna 104, 106, 108, 110, 112, and 114 via different feeds paths from the directional coupler to the horn antenna.

It is appreciated that the meandering waveguide shown in FIGS. 1-6, 9A, 9B, and 10 may be operated in a dual mode fashion themselves where the ends of the meandering waveguides may be fed by feeder OMTs in order to launch a vertically or horizontally polarized waves into the meandering waveguide itself. These vertically and horizontally polarized waves may then be coupled by the respective directional couplers into the different horns to produce the designed polarizations outputs at the horns.

As an example of operation, both the first and second implementations of the antenna array system may be utilized as standalone antenna systems (i.e., direct radiation system) or as part of a reflector antenna system. Turing to FIG. 11, a prospective view of an example of an implementation of a reflector antenna system 1100 is shown in accordance with the present invention. The reflector antenna system 1100 may include an antenna array system 1102 and a cylindrical reflector element 1104. The antenna array system 1102 may be either the first implementation of the antenna array system 100 (shown in FIGS. 1-6) or the second implementation of the antenna array system 900 (shown in FIGS. 9-10). In operation, the antenna array system 1104 acts a feed array for the reflector element 1104 and directs radiation 1106 towards the reflector element 1104 that is in turn reflected into free space to form the antenna beam 1108 of the reflector antenna system 1100. The reflector antenna system 1100 may be used for many different applications. Again, it is appreciated by those skilled in the art that the reflector antenna system 1100 is an optional implementation of the antenna array system. Another example (not shown), is includes the antenna array system utilized as a standalone antenna system that is a direct radiation system without an reflector system.

Figure 11:
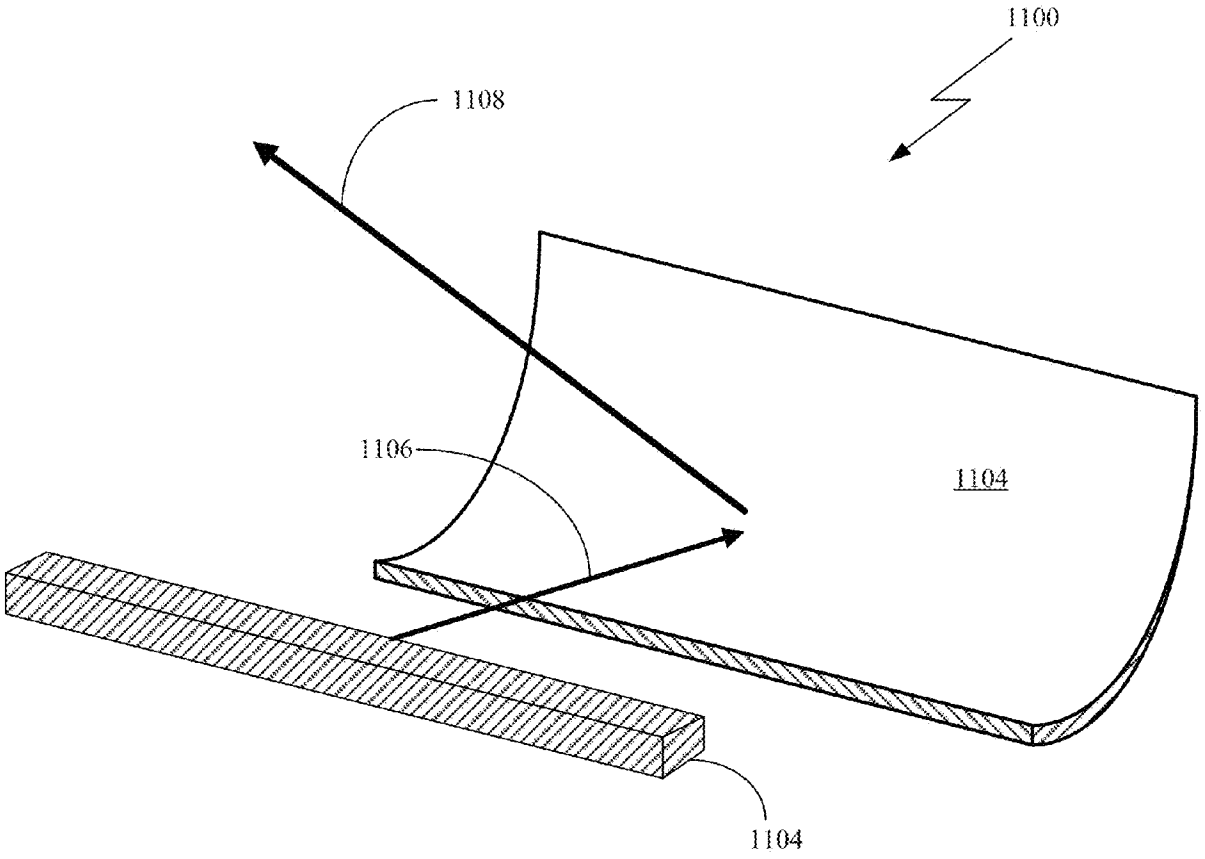
FIG. 11 is a prospective view of an example of an implementation of a reflector antenna system utilizing the antenna array system in accordance with the present invention.
Figure 12:
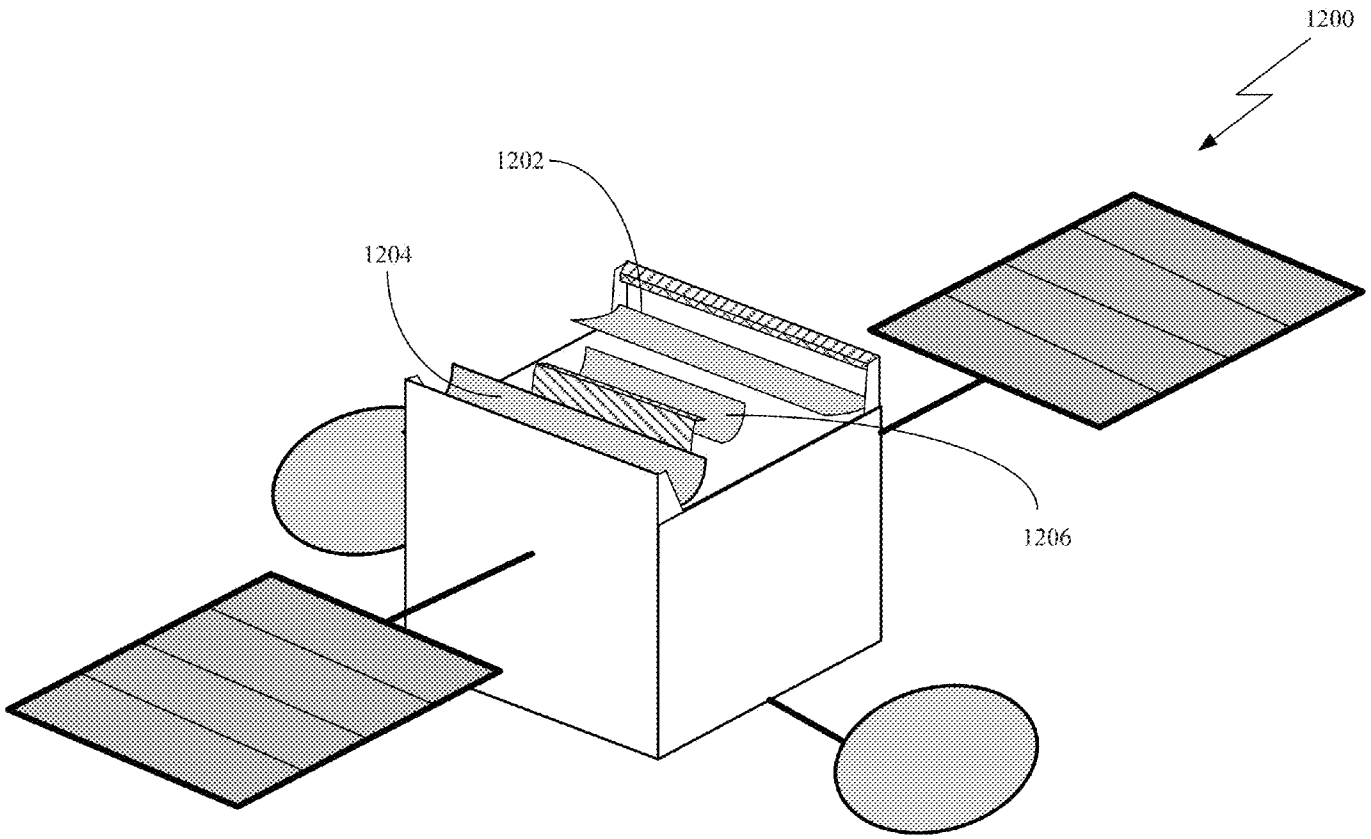
FIG. 12 is a perspective view of a communication satellite utilizing the reflector antenna system shown in FIG. 11.

In FIG. 12, a perspective view of a communication satellite 1200 is shown utilizing the reflector antenna system shown in FIG. 11. In this example, the communication satellite 1200 may include two reflector antenna systems 1202 and 1204 for transmission and a signal reflector antenna system 1206 for reception.

It will be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

It will be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

What is claimed is:

1. An antenna array system for directing and steering an antenna beam, the antenna array system comprising:

a feed waveguide having a feed waveguide wall, a feed waveguide length, at least one turn along the feed waveguide length, a first feed waveguide input at a first end of the feed waveguide, and a second feed waveguide input at a second end of the feed waveguide, wherein the feed waveguide is configured to receive a first input signal at the first feed waveguide input and a second input signal at the second feed waveguide input, and at least two directional couplers in signal communication with the feed waveguide, wherein each directional coupler, of the at least two directional couplers, has a bottom wall that is adjacent to the waveguide wall of the feed waveguide, and wherein each directional coupler is configured to produce a first coupled signal from the first input signal and a second coupled signal from the second input signal;

at least two pairs of planar coupling slots along the feed waveguide length, wherein a first pair of planar coupling slots, of the at least two pairs of planar coupling slots, corresponds to the a first directional coupler, of the at least two directional couplers, and a second pair of planar coupling slots, of the at least two pairs of planar coupling slots, corresponds to the a second directional coupler, of the at least two directional couplers, wherein the first pair of planar coupling slots are cut into the feed waveguide wall of the feed waveguide and the adjacent bottom wall of the first directional coupler and the second pair of planar coupling slots are cut into the feed waveguide wall of the feed waveguide and the adjacent bottom wall of the second directional coupler; and at least two horn antennas, wherein a first horn antenna, of the at least two horn antennas, is in signal communication with the first directional coupler and a second horn antenna, of the at least two horn antennas, is in signal communication with the second directional coupler, wherein the first horn antenna is configured to receive both the first coupled signal and the second coupled signal from the first directional coupler and the second horn antenna is configured to receive both the first coupled signal and the second coupled signal from the second directional coupler, wherein the first horn antenna is configured to produce a first polarized signal from the received first coupled signal and a second polarized signal from the received second coupled signal and the second horn antenna is configured to produce a first polarized signal from the received first coupled signal and a second polarized signal from the received second coupled signal, wherein the first polarized signal of the first horn antenna is cross polarized with the second polarized signal of the first horn antenna and the first polarized signal of the second horn antenna is cross polarized with the second polarized signal of the second horn antenna, and wherein the first polarized signal of the first horn antenna is polarized in the same direction as the first polarized signal of the second horn antenna and second polarized signal of the first horn antenna is polarized in the same direction as the second polarized signal of the second horn antenna.

2. The antenna array system of claim 1, further including at least four power amplifiers, wherein a first power amplifier, of the at least four power amplifiers, is in signal communication with the first directional coupler and the first horn antenna and is configured to amplify the first coupled signal from the first directional coupler, wherein a second power amplifier, of the at least four power amplifiers, is in signal communication with the first directional coupler and the first horn antenna and is configured to amplify the second coupled signal from the first directional coupler, wherein a third power amplifier, of the at least four power amplifiers, is in signal communication with the second directional coupler and the second horn antenna and is configured to amplify the first coupled signal from the second directional coupler, and wherein a fourth power amplifier, of the at least four power amplifiers, is in signal communication with the second directional coupler and the second horn antenna and is configured to amplify the second coupled signal from the second directional coupler.

3. The antenna array system of claim 1, wherein the feed waveguide is a rectangular waveguide having a broad-wall and a narrow-wall.

4. The antenna array system of claim 3, wherein the feed waveguide wall is the broad-wall.

5. The antenna array system of claim 4, wherein a first planar coupling slot and a second planar coupling slot, of the first pair of planar coupling slots, are positioned approximately a quarter-wavelength apart and wherein a first planar coupling slot and a second planar coupling slot, of the second pair of planar coupling slots, are positioned approximately a quarter-wavelength apart.

6. The antenna array system of claim 5, further including a first septum polarizer in the first horn antenna and a second septum polarizer in the second horn antenna, wherein the first horn antenna is configured to produce a first polarized signal from the received first coupled signal and a second polarized signal from the received second coupled signal and the second horn antenna is configured to produce a first polarized signal from the received first coupled signal and a second polarized signal from the received second coupled signal, wherein the first polarized signal of the first horn antenna is a first circularly polarized signal of the first horn antenna and the second polarized signal of the first horn antenna is a second circularly polarized signal of the first horn antenna, wherein the first polarized signal of the second horn antenna is a first circularly polarized signal of the second horn antenna and the second polarized signal of the second horn antenna is a second circularly polarized signal of the second horn antenna, wherein the first circularly polarized signal of the first horn antenna rotates in the opposite direction of the second circularly polarized signal of the first horn antenna and the first circularly polarized signal of the second horn antenna rotates in the opposite direction of the second circularly polarized signal of the second horn antenna, and wherein the first circularly polarized signal of the first horn antenna rotates in the same direction as the first circularly polarized signal of the second horn antenna and second circularly polarized signal of the first horn antenna rotates in the same direction as the second circularly polarized signal of the second horn antenna.

7. The antenna array system of claim 6, wherein the feed waveguide is a meandering waveguide.

8. The antenna array system of claim 7, further including a first circulator and a second circulator, wherein the first circulator is in signal communication with the first feed waveguide input and the second circulator is signal communication with the second feed waveguide input.

9. The antenna array system of claim 1, further including a reflector in signal communication with the even plurality of horn antennas.

10. A method for directing and steering an antenna beam utilizing an antenna array system having a feed waveguide with a first feed waveguide input, a second feed waveguide, and a feed waveguide length, at least two directional couplers in signal communication with the feed waveguide, at least two pairs of planar coupling slots along the feed waveguide length, and at least two horn antennas, the method comprising:

receiving a first input signal at the first feed waveguide input and a second input signal at the second feed waveguide input, wherein the second input signal is propagating in the opposite direction of the first input signal;

coupling the first input signal to a first directional coupler, of the at least two directional couplers, wherein the first directional coupler produces a first coupled output signal of the first directional coupler;

coupling the first input signal to a second directional coupler, of the at least two directional couplers, wherein the second directional coupler produces a first coupled output signal of the second directional coupler;

coupling the second input signal to the second directional coupler, wherein the second directional coupler produces a second coupled output signal of the second directional coupler;

coupling the second input signal to the first directional coupler, wherein the first directional coupler produces a second coupled output signal of the first directional coupler;

radiating a first polarized signal from a first horn antenna, of the at least two horn antennas, in response to the first horn antenna receiving the first coupled output signal of the first directional coupler;

radiating a second polarized signal from the first horn antenna, in response to the first horn antenna receiving the second coupled output signal of the first directional coupler;

radiating a first polarized signal from a second horn antenna, of the at least two horn antennas, in response to the second horn antenna receiving the second coupled output signal of the second directional coupler; and radiating a second polarized signal from the second horn antenna, in response to the second horn antenna receiving the second coupled output signal of the second directional coupler, wherein the first polarized signal of the first horn antenna is cross polarized with the second polarized signal of the first horn antenna and the first polarized signal of the second horn antenna is cross polarized with the second polarized signal of the second horn antenna, and wherein the first polarized signal of the first horn antenna is polarized in the same direction as the first polarized signal of the second horn antenna and second polarized signal of the first horn antenna is polarized in the same direction as the second polarized signal of the second horn antenna.

11. The method of claim 10, further including amplifying the first coupled output signals from both the first and second directional couplers and the second coupled output signals from both the first and second directional couplers.

12. The method of claim 11, wherein the first input signal and second input signal are $TE_{10}$ mode signals propagating in opposite directions through the feed waveguide.

13. The method of claim 12, wherein the feed waveguide is a meandering waveguide and further including delaying the first input signal and second input signal utilizing the meandering waveguide.

14. An antenna array system for directing and steering an antenna beam, the antenna array system comprising:

a feed waveguide having a feed waveguide wall, a feed waveguide length, at least five turns along the feed waveguide length, a first feed waveguide input at a first end of the feed waveguide, and a second feed waveguide input at a second end of the feed waveguide, wherein the feed waveguide is configured to receive a first input signal at the first feed waveguide input and a second input signal at the second feed waveguide input, and at least four directional couplers in signal communication with the feed waveguide, wherein each directional coupler, of the at least four directional couplers, has a bottom wall that is adjacent to the waveguide wall of the feed waveguide, and wherein each directional coupler is configured to produce a coupled signal from either the first input signal or the second input signal;

at least four pairs of planar coupling slots along the feed waveguide length, wherein a first pair of planar coupling slots, of the at least four pairs of planar coupling slots, corresponds to the a first directional coupler, of the at least four directional couplers, a second pair of planar coupling slots, of the at least four pairs of planar coupling slots, corresponds to the a second directional coupler, of the at least four directional couplers, a third pair of planar coupling slots, of the at least four pairs of planar coupling slots, corresponds to the a third directional coupler, of the at least four directional couplers, and a fourth pair of planar coupling slots, of the at least four pairs of planar coupling slots, corresponds to the a fourth directional coupler, of the at least four directional couplers, wherein the first pair of planar coupling slots are cut into the feed waveguide wall of the feed waveguide and the adjacent bottom wall of the first directional coupler, the second pair of planar coupling slots are cut into the feed waveguide wall of the feed waveguide and the adjacent bottom wall of the second directional coupler, the third pair of planar coupling slots are cut into the feed waveguide wall of the feed waveguide and the adjacent bottom wall of the third directional coupler, and the fourth pair of planar coupling slots are cut into the feed waveguide wall of the feed waveguide and the adjacent bottom wall of the fourth directional coupler; and at least two horn antennas, wherein a first horn antenna, of the at least two horn antennas, is in signal communication with the first directional coupler and the second directional coupler and a second horn antenna, of the at least two horn antennas, is in signal communication with the third directional coupler and the fourth directional coupler, wherein the first horn antenna is configured to receive the coupled signal from the first directional coupler and the coupled signal from the second directional coupler and the second horn antenna is configured to receive the coupled signal from the third directional coupler and the coupled signal from the fourth directional coupler, wherein the first horn antenna is configured to produce a first circularly polarized signal from the received coupled signal from the first directional coupler and a second circularly polarized signal from the received coupled signal from the second directional coupler and the second horn antenna is configured to produce a first circularly polarized signal from the received coupled signal from the third directional coupler and a second circularly polarized signal from the received coupled signal from the fourth directional coupler, wherein the first circularly polarized signal of the first horn antenna rotates in the opposite direction of the second circularly polarized signal of the first horn antenna and the first circularly polarized signal of the second horn antenna rotates in the opposite direction of the second circularly polarized signal of the second horn antenna, and wherein the first circularly polarized signal of the first horn antenna rotates in the same direction as the first circularly polarized signal of the second horn antenna and second circularly polarized signal of the first horn antenna rotates in the same direction as the second circularly polarized signal of the second horn antenna.

15. The antenna array system of claim 14, further including at least four power amplifiers, wherein a first power amplifier, of the at least four power amplifiers, is in signal communication with the first directional coupler and the first horn antenna and is configured to amplify the coupled signal from the first directional coupler, wherein a second power amplifier, of the at least four power amplifiers, is in signal communication with the second directional coupler and the first horn antenna and is configured to amplify the coupled signal from the second directional coupler, wherein a third power amplifier, of the at least four power amplifiers, is in signal communication with the third directional coupler and the second horn antenna and is configured to amplify the coupled signal from the third directional coupler, and wherein a fourth power amplifier, of the at least four power amplifiers, is in signal communication with the fourth directional coupler and the second horn antenna and is configured to amplify the coupled signal from the fourth directional coupler.

16. The antenna array system of claim 15, wherein the feed waveguide is a rectangular waveguide having a broad-wall and a narrow-wall.

17. The antenna array system of claim 16, wherein the feed waveguide wall is the broad-wall.

18. The antenna array system of claim 17, wherein a first planar coupling slot and a second planar coupling slot, of the first pair of planar coupling slots, are positioned approximately a quarter-wavelength apart, wherein a first planar coupling slot and a second planar coupling slot, of the second pair of planar coupling slots, are positioned approximately a quarter-wavelength apart, wherein a first planar coupling slot and a second planar coupling slot, of the third pair of planar coupling slots, are positioned approximately a quarter-wavelength apart, and wherein a first planar coupling slot and a second planar coupling slot, of the fourth pair of planar coupling slots, are positioned approximately a quarter-wavelength apart.

19. The antenna array system of claim 5, further including a first septum polarizer in the first horn antenna and a second septum polarizer in the second horn antenna.

20. The antenna array system of claim 19, wherein the feed waveguide is a meandering waveguide.

* * * * *